US010793336B2

(12) United States Patent
Zhang

(10) Patent No.: US 10,793,336 B2
(45) Date of Patent: Oct. 6, 2020

(54) CROSSED, STAGGERED AND STACKED-TYPE AIR PACKAGING DEVICE, AND MANUFACTURING METHOD THEREFOR

(71) Applicant: Shanghai Air-Paq Composite Material Co., Ltd., Shanghai (CN)

(72) Inventor: Jiaying Zhang, Shanghai (CN)

(73) Assignee: Shanghai Air-Paq Composite Material Co., Ltd., Shanghai (CN)

( * ) Notice: Subject to any disclaimer, the term of this patent is extended or adjusted under 35 U.S.C. 154(b) by 19 days.

(21) Appl. No.: 15/528,094

(22) PCT Filed: Nov. 18, 2015

(86) PCT No.: PCT/CN2015/094891
§ 371 (c)(1),
(2) Date: Sep. 13, 2017

(87) PCT Pub. No.: WO2016/078578
PCT Pub. Date: May 26, 2016

(65) Prior Publication Data

US 2018/0127152 A1 May 10, 2018

(30) Foreign Application Priority Data

Feb. 4, 2015 (CN) ..... 2015 1 0057266

(51) Int. Cl.
*B65D 25/04* (2006.01)
*B65D 81/03* (2006.01)
(Continued)

(52) U.S. Cl.
CPC ..... *B65D 81/03* (2013.01); *B31D 5/0073* (2013.01); *B65D 23/08* (2013.01); *B65D 25/04* (2013.01);
(Continued)

(58) Field of Classification Search
CPC .... B65D 81/03; B65D 81/052; B65D 81/053; B65D 81/055; B65D 81/056;
(Continued)

(56) References Cited

U.S. PATENT DOCUMENTS 7,624,788 B2 * 12/2009 Brown ..... F28D 21/0015 165/83
2004/0149618 A1 * 8/2004 Otaki ..... B65D 81/052 206/521

(Continued)

*Primary Examiner* — Robert Poon
(74) *Attorney, Agent, or Firm* — Raymond Y Chan; David and Raymond Patent Firm

(57) ABSTRACT

The present invention provides a crossed staggered and stacked-type air packaging device and a manufacturing method therefor. The crossed staged and stacked-type air packaging device includes at least two inflation packaging main body layers, so as to form an accommodation cavity used for storing an article to be packaged. Each inflation packaging main body layer includes at least one sub-inflation unit. The sub-inflation units of at least two adjacent inflation packaging main body layers have different extending directions, so that at least two adjacent inflation packaging main body layers are arranged in a crossed and staggered manner.

2 Claims, 9 Drawing Sheets

(51) Int. Cl.

| | |
|---|---|
| ***B65D 23/08*** | (2006.01) |
| ***B31D 5/00*** | (2017.01) |
| ***B65D 81/05*** | (2006.01) |
| ***B65D 83/00*** | (2006.01) |
| ***G07F 11/00*** | (2006.01) |
| *B65B 55/20* | (2006.01) |

(52) U.S. Cl.
CPC ..... *B65D 81/052* (2013.01); *B65D 83/0055* (2013.01); *G07F 11/00* (2013.01); *B65B 55/20* (2013.01); *B65D 2207/00* (2013.01); *B65D 2581/055* (2013.01)

(58) Field of Classification Search
CPC .. B65D 81/057; B65D 81/05; B65D 81/1275; B65D 81/133; B65D 81/051
USPC ..... 206/521, 522, 586
See application file for complete search history.

(56) References Cited

U.S. PATENT DOCUMENTS

| | | | | |
|---|---|---|---|---|
| 2004/0163991 | A1* | 8/2004 | Koyanagi | B65D 81/052 206/521 |
| 2006/0093763 | A1* | 5/2006 | Tanaka | B65D 81/052 428/35.2 |
| 2008/0044109 | A1* | 2/2008 | Liao | B32B 3/20 383/3 |
| 2008/0159659 | A1* | 7/2008 | Liao | B65D 81/052 383/3 |
| 2009/0188830 | A1* | 7/2009 | Liao | B65D 81/052 206/522 |
| 2013/0270145 | A1* | 10/2013 | Takenaka | B65D 81/022 206/521 |
| 2015/0144520 | A1* | 5/2015 | Liao | B65D 81/052 206/522 |

* cited by examiner

B-B

CROSSED, STAGGERED AND STACKED-TYPE AIR PACKAGING DEVICE, AND MANUFACTURING METHOD THEREFOR

CROSS REFERENCE OF RELATED APPLICATION

This is a U.S. National Stage under 35 U.S.C. 371 of the International Application Number PCT/CN2015/094891, filed Nov. 18, 2015, which claims priority under 35 U.S.C. 119(a-d) to Chinese application numbers 201410673714.9, filed Nov. 21, 2014, and 201510057266.4, filed Feb. 4, 2015. The afore-mentioned patent applications are hereby incorporated by reference in their entireties.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to an air packaging device, and more particularly to a crossed staggered and stacked-type air packaging device and manufacturing method therefor. The crossed staggered and stacked-type air packaging device comprises two or more inflation packaging main body layers. Adjacent inflation packaging main body layers are arranged in a crossed and staggered manner, so as to enhance the cushion performance of the crossed staggered and stacked-type air packaging device.

Description of Related Arts

In general, articles should be packaged before transported via logistics, so as to prevent articles being damaged and out of shape due to being fallen or thrown during being transported.

Along with phenomenal development of electronic commerce and logistics transportation, the manner of packaging articles using material filled with air is more and more widely applied and popularized. Relative to traditional cushion materials made of foam material, air packaging materials have more advantages. For example, due to air is used as filing material, air packaging materials are light themselves, so that the application of the air packaging materials will not increase the weight of the article being transported. The air packaging materials are conductive to environment protecting. The air packaging materials may not filled with air before being applied. In other words, air should be inflated into the air packaging materials while the air packaging materials is used. Hence, air packaging materials occupy small transportation space and small storage space, so as to reduce application cost of the air packaging materials. More important, the shapes of the air packaging materials change automatically corresponding with the appearance of articles after the air packaging materials are applied, so as to pack the outside surfaces of the articles. In addition, after packing the articles, the air packaging materials provide better cushion performance relative to traditional cushion materials.

Referring to traditional air packaging materials, two layers of overlapped thin film materials are heat sealed along border positions, so as to form an inflatable main body. The inflatable main body forms inflation cavities and inflating channels used for inflating gas into the inflation cavities. The inflatable main body is bended and folded to form an accommodation cavity used to accommodate an article. It is easy to be understood that after the article is accommodated into the accommodation cavity, only one layer of inflatable main body is provided to each side of the article. Although the layer of inflatable main body can provide better cushion performance relative to foam materials, force applied by some other objects touched will directly act to the surface of the article via the layer of inflatable main body, so that the corresponding position of the article is damaged by the focused force. In addition, once the air packaging material is damaged, the cushion effect in the damaged position will be lost immediately, so that the protection effect of the air packaging material in the corresponding position will be lost.

SUMMARY OF THE PRESENT INVENTION

The invention is advantageous in that it provides a crossed staggered and stacked-type air packaging device and manufacturing method therefor, wherein the crossed staggered and stacked-type air packaging device comprises two or more inflation packaging main body layers. Adjacent inflation packaging main body layers are arranged in a crossed and staggered manner, so as to enhance the cushion performance of the crossed staggered and stacked-type air packaging device.

Another advantage of the invention is to provide a crossed staggered and stacked-type air packaging device and manufacturing method therefor, wherein two or more inflation packaging main body layers form the crossed staggered and stacked-type air packaging device in a heat-sealing manner or an integrative manner. The craftsmanship is simple, so as to reduce the manufacturing cost of the crossed staggered and stacked-type air packaging device.

Another advantage of the invention is to provide a crossed staggered and stacked-type air packaging device and manufacturing method therefor, wherein the crossed and staggered stacked two or more inflation packaging main body layers comprises at least one sub-inflation unit. The extending direction of at least one of the sub-inflation unit is different from the extending direction of at least one of the sub-inflation unit of the adjacent inflation packaging main body layer, so that each of the crossed and staggered stacked inflation packaging main body layers evidently enhances the cushion performance of the crossed staggered and stacked-type air packaging device.

Another advantage of the invention is to provide a crossed staggered and stacked-type air packaging device and manufacturing method therefor, wherein two inflation packaging main body layers comprises an inner inflation packaging main body layer and an outer inflation packaging main body layer and defines an accommodation cavity, so as to accommodate at least one article within. The outer inflation packaging main body layer is stacked outside the inner inflation packaging main body layer, so as to form a bag-in-bag structure, so as to enhance the cushion performance of the crossed staggered and stacked-type air packaging device.

Another advantage of the invention is to provide a crossed staggered and stacked-type air packaging device and manufacturing method therefor, wherein the inner inflation packaging main body layer comprises at least one inner inflation unit. The outer inflation packaging main body layer comprises at least one outer inflation unit. The extending direction of at least one inner inflation unit is different from the extending direction of at least one outer inflation unit, so that the inner inflation packaging main body layer and the outer inflation packaging main body layer form a crossed and staggered stacked structure, so as to enhance the cushion performance of the crossed staggered and stacked-type air packaging device via the crossed and staggered arranged inner inflation unit and outer inflation unit.

Another advantage of the invention is to provide a crossed staggered and stacked-type air packaging device and manufacturing method therefor, wherein the inner inflation packaging main body layer and the outer inflation packaging main body layer respectively comprise at least one dividing seam. At least one of the dividing seam of the inner inflation packaging main body layer is stacked with at least two outer inflation units of the outer inflation packaging main body layer. Correspondingly, at least one of the dividing seam of the outer inflation packaging main body layer is stacked with at least two inner inflation units of the inner inflation packaging main body layer. Hence, even if any one of the inflation unit of any one of the inflation packaging main body layers is damaged, the inflation unit of the other inflation packaging main body layer still can provide cushion effect, so as to ensure the reliability of the crossed staggered and stacked-type air packaging device being applied.

Another advantage of the invention is to provide a crossed staggered and stacked-type air packaging device and manufacturing method therefor, wherein the shape of the crossed staggered and stacked-type air packaging device can be triangle spatial configuration, rectangle spatial configuration, or some other spatial configurations. Hence, the crossed staggered and stacked-type air packaging device is suitable to be used to the article to be packaged, so as to enlarge the scope of application of the crossed staggered and stacked-type air packaging device.

Another advantage of the invention is to provide a crossed staggered and stacked-type air packaging device and manufacturing method therefor, wherein the inner inflation unit of the inner inflation packaging main body layer and the outer inflation unit of the outer inflation packaging main body layer can be inflated with gas at the same time, so as to reduce the operation steps of packaging the article to be packaged by the crossed staggered and stacked-type air packaging device.

Another advantage of the invention is to provide a crossed staggered and stacked-type air packaging device and manufacturing method therefor, wherein the inner inflation packaging main body layer forms two free ends. After the crossed staggered and stacked-type air packaging device is inflated with gas, the free ends of the inner inflation packaging main body layer close to each other automatically, so that the size of the accommodation cavity formed by the inner inflation packaging main body layer is smaller and smaller in the direction far from the opening of the accommodation cavity. After the article to be packaged is accommodated within the accommodation cavity, the free ends of the inner inflation packaging main body layer clamp the article automatically. Hence, after the packaging via the crossed staggered and stacked-type air packaging device is finished, the crossed staggered and stacked-type air packaging device will not fall off the article due to inartificial reasons, so as to enhance the reliability of the crossed staggered and stacked-type air packaging device applied.

Another advantage of the invention is to provide a crossed staggered and stacked-type air packaging device and manufacturing method therefor, wherein the inner inflation packaging main body layer and the outer inflation packaging main body layer are stacked, so that after the crossed staggered and stacked-type air packaging device is u crossed staggered and stacked-type air packaging device is used to package an article, each side of the article is provided with two inflation packaging main body layers, so that the article is provided with better cushion effect.

Another advantage of the invention is to provide a crossed staggered and stacked-type air packaging device and manufacturing method therefor, wherein a cushion space is formed between the inner inflation packaging main body layer and the outer inflation packaging main body layer. Hence, impact stress acted to the outer inflation packaging main body layer will not directly act to the article being packaged. The cushion space enhances cushion effect together with the outer inflation packaging main body layer and the inner inflation packaging main body layer. For example, after the impact stress is acted to the outer inflation packaging main body layer, the cushion space provide cushion stroke to the outer inflation packaging main body layer. Hence, the inner inflation packaging main body layer is acted by the impact stress after the cushion space provides corresponding cushion effect. Then the inner inflation packaging main body layer further provides cushion effect. Hence, the impact stress acted to the outer inflation packaging main body layer is dispersed, so as to ensure the safety of the article.

Additional advantages and features of the invention will become apparent from the description which follows, and may be realized by means of the instrumentalities and combinations particular point out in the appended claims.

According to the present invention, the foregoing and other objects and advantages are attained by a crossed staggered and stacked-type air packaging device. The crossed staggered and stacked-type air packaging device comprises two inflation packaging main body layers and forms an accommodation cavity used to accommodate an article to be packaged, wherein each said inflation packaging main body layer comprises at least one sub-inflation unit, wherein each said sub-inflation unit of two said inflation packaging main body layers extends in different directions, so that at least two adjacent said inflation packaging main body layers are arranged in a crossed and staggered manner.

Preferably, at least two said inflation packaging main body layers comprises an inner inflation packaging main body layer and an outer inflation packaging main body layer. The outer inflation packaging main body layer is crossed stacked outside said inner inflation packaging main body layer.

Preferably, the number of the inflation packaging main body layers is 2~20.

Preferably, said inner inflation packaging main body layer and said outer inflation packaging main body layer are fastened in a heat-sealing manner or a bonding manner, so that the inner inflation packaging main body layer and the outer inflation packaging main body layer are crosswise arranged.

Preferably, said inner inflation packaging main body layer and said outer inflation packaging main body layer are integrally formed by an inflatable main body. The inflatable main body comprises at least one inner inflation unit and at least one outer inflation unit respectively formed by said sub-inflation unit. Each said inner inflation unit forms said inner inflation packaging main body layer. Each said outer inflation unit forms said outer inflation packaging main body layer.

Preferably, said inflatable main body comprises a plurality of inflation units arranged side by side and a plurality of turning seams. The turning seams are provided, so that said inflation units form said sub-inflation units and said inflatable main body is bended to turn along said turning seams, so as to form said inner inflation packaging main body layer and said outer inflation packaging main body layer arranged crosswise.

Preferably, said inflatable main body further comprises a turning portion between adjacent said turning seams. The turning portion integrally connects with said inner inflation packaging main body layer and said outer inflation packaging main body layer.

Preferably, said turning portion further comprises a plurality of turning inflation units. Each said turning inflation unit extends between adjacent said turning seams, so as to communicate each said sub-inflation unit of said inner inflation packaging main body layer and each said sub-inflation unit of said outer inflation packaging main body layer.

Preferably, said inflatable main body comprises two or more rows of inflation units extending in different directions. Adjacent rows of said inflation units respectively forms said inner inflation unit and said outer inflation unit, so that said inner inflation packaging main body layer formed by said inner inflation units and said outer inflation packaging main body layer formed by said outer inflation units extend in different directions.

Preferably, two or more rows of said inflation units comprise two rows of said inflation units respectively formed to said inner inflation packaging main body layer and said outer inflation packaging main body layer. Each row of said inflation units extend in different directions, so that said inner inflation packaging main body layer and said outer inflation packaging main body layer are arranged crosswise.

Preferably, two or more rows of said inflation units comprise three rows of said inflation units respectively formed to two said inner inflation packaging main body layers and said outer inflation packaging main body layer. At least two rows of said inflation units extend in different directions. Each said inner inflation unit is symmetrically formed to said outer inflation unit, so that said inner inflation packaging main body layer and said outer inflation packaging main body layer are arranged crosswise.

Preferably, said inner inflation packaging main body layer has two free ends, so that the size of the accommodation cavity is smaller and smaller while extending far away from an opening of said accommodation cavity.

Preferably, said inner inflation packaging main body layer is hung within said outer inflation packaging main body layer.

Preferably, the angle between said sub-inflation unit of said inner inflation packaging main body layer and said sub-inflation unit of said outer inflation packaging main body layer is greater than 0°, and less than 90°.

Preferably, the extending direction of said sub-inflation unit of said inner inflation packaging main body layer is vertical with the extending direction of said sub-inflation unit of said outer inflation packaging main body layer.

Preferably, the diameter size of said sub-inflation unit of said inner inflation packaging main body layer is different from the diameter size of said sub-inflation unit of said outer inflation packaging main body layer, or the diameter size of said sub-inflation unit of said inner inflation packaging main body layer is equal to the diameter size of said sub-inflation unit of said outer inflation packaging main body layer.

Preferably, the side portion of said outer inflation packaging main body layer is provided with one or more said sub-inflation unit with big diameter size.

Preferably, said outer inflation packaging main body layer further has at least one external connection seam. The external connection seam is provided between at least two said outer inflation units.

Preferably, said outer inflation packaging main body layer comprises one or more folding portions, so that the shape of the corner position of said outer inflation packaging main body layer is roughly rectangular after being folded.

Preferably, said inner inflation packaging main body layer comprises one or more folding portions, so that the shape of the corner position of said inner inflation packaging main body layer is roughly rectangular after being folded. The outer inflation packaging main body layer comprises one or more folding portions, so that the shape of the corner position of said outer inflation packaging main body layer is roughly rectangular after being folded.

Preferably, the inflation volume of said folding portions is reduced via at least one air rejecting seam.

Preferably, said folding portions are un-inflatable portions.

Preferably, said inflatable main body is formed by heat-sealing and folding a first chamber layer and a second chamber layer. The inflatable main body forms an inflation opening and a main channel. Each said inflation unit is provided with at least one inflation valve.

Preferably, said inflation valve comprises two valve films respectively sealed together with said first chamber layer and said second chamber layer of said inflatable main body. An air inflating channel is formed between two said valve films. After said inflation unit is inflated with gas via said air inflating channel, the internal surfaces of said two valve films adsorb each other automatically, so as to prevent gas in said inflation unit from reverse leaking through said air inflating channel.

Preferably, said inflation valve is a self-adhesive film check valve comprising a first valve film, a second valve film, and a check sealing film. The first valve film and said third valve film are provided to outer layers. The second valve film is provided between said first valve film and said third valve film. The air inflating channel is formed between said first valve film and said second valve film. A check cavity is formed between said second valve film and said check sealing film. After inflating gas into said inflation unit via said air inflating channel, the internal surfaces of said first valve film, said second valve film, and said check sealing film adsorb each other automatically, so as to prevent gas in said inflation unit from reverse leaking through said air inflating channel. If gas returns, gas enters into said check cavity. Gas entered into said check cavity press said second valve film, so as to further close said air inflating channel, so as to prevent gas leaking reversely.

In accordance with another aspect of the invention, the present invention comprises a method of manufacturing a crossed staggered and stacked-type air packaging device, comprising the following steps:

(a) forming at least one inner inflation unit and at least one outer inflation unit to an inflatable main body; and (b) forming an inner inflation packaging main body layer and an outer inflation packaging main body layer at least partially stacked with each other by bending said inner inflation unit or bending said outer inflation unit. The extending direction of at least one said inner inflation unit of said inner inflation packaging main body layer is different from the extending direction of at least one said outer inflation unit of said outer inflation packaging main body layer, so as to form a crossed, staggered and stacked structure.

Preferably, the step (a) further comprises the following steps:

(a.1) overlapping a first chamber layer, a second chamber layer and valve films forming an inflation valve, and forming said inflatable main body being able to store gas; and (a.2) heat-sealing said first chamber layer, said second chamber layer and said valve films along a plurality of dividing seams, so as to form a plurality of side by side and independent inflation units. Each said inflation unit is provided with at least one said inflation valve. The inflatable main body forms an inflation opening and a main channel. Air enters into said main channel from said inflation opening and then enters into each said inflation unit through said inflation valve. The inflation unit forms said inner inflation unit and said outer inflation unit.

Preferably, the step (a) further comprises the following steps:

(a. 3) overlapping a first chamber layer, a second chamber layer and valve films forming an inflation valve, and forming said inflatable main body being able to store gas; and (a. 4) heat-sealing said first chamber layer, said second chamber layer and said valve films along a plurality of dividing seams, so as to form at least two rows of side by side and independent inflation units. Each row of said inflation unit has different extending directions. Each said inflation unit is provided with at least one said inflation valve. The inflatable main body forms an inflation opening and a main channel. Air enters into said main channel from said inflation opening and then enters into each said inflation unit through said inflation valve. The inflation unit forms said inner inflation unit and said outer inflation unit.

Preferably, the step (b) further comprises the following step: bending said inflatable main body along at least one bending seam, so as to form said inner inflation packaging main body layer and said outer inflation packaging main body layer. The inner inflation packaging main body layer and said outer inflation packaging main body layer are crossed arranged.

Preferably, the step (b) further comprises the following step: bending said inflatable body along turning seams, so as to form crossed arranged said inner inflation packaging main body layer and said outer inflation packaging main body layer.

Preferably, the method further comprises the following step: forming one or more turning portions connecting said inner inflation packaging main body layer and said outer inflation packaging main body layer.

Preferably, the crossed staggered and stacked-type air packaging device forms an air packaging body with a triangle spatial configuration.

Preferably, the crossed staggered and stacked-type air packaging device forms an air packaging body with a rectangle spatial configuration.

Preferably, the angle between said inner inflation unit of said inner inflation packaging main body layer and said outer inflation unit of said outer inflation packaging main body layer is greater than 0°, and less than 90°.

Preferably, the extending direction of said inner inflation unit of said inner inflation packaging main body layer is vertical with the extending direction of said outer inflation unit of said outer inflation packaging main body layer.

Preferably, the inner inflation unit of said inner inflation packaging main body layer is formed integrally connecting with said outer inflation unit of said outer inflation packaging main body layer.

Preferably, the inner inflation unit of said inner inflation packaging main body layer is formed integrally connecting with said outer inflation unit of said outer inflation packaging main body layer.

Preferably, the inflation valve comprises two valve films respectively sealed together with said first chamber layer and said second chamber layer of said inflatable main body. An air inflating channel is formed between two said valve films. After said inflation unit is inflated with gas via said air inflating channel, the internal surfaces of said two valve films adsorb each other automatically, so as to prevent gas in said inflation unit from reverse leaking through said air inflating channel.

Preferably, the inflation valve is a self-adhesive film check valve comprising a first valve film, a second valve film, and a check sealing film. The first valve film and said third valve film are provided to outer layers. The second valve film is provided between said first valve film and said third valve film. The air inflating channel is formed between said first valve film and said second valve film. A check cavity is formed between said second valve film and said check sealing film. After inflating gas into said inflation unit via said air inflating channel, the internal surfaces of said first valve film, said second valve film, and said check sealing film adsorb each other automatically, so as to prevent gas in said inflation unit from reverse leaking through said air inflating channel. If gas returns, gas enters into said check cavity. Gas entered into said check cavity press said second valve film, so as to further close said air inflating channel, so as to prevent gas leaking reversely.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

FIGS. 1~4B illustrate a crossed staggered and stacked-type air packaging device according to a preferred embodiment of the present invention. The crossed staggered and stacked-type air packaging device comprises two or more inflation packaging main body layers. At least two of the inflation packaging main body layers are stacked in a crossed and staggered manner, so as to enhance the cushion performance of the crossed staggered and stacked-type air packaging device. Relative to traditional air packaging devices, the crossed staggered and stacked-type air packaging device has great improvement.

It is worth mentioning that the number of the inflation packaging main body layers is not limited according to different embodiments. For example, the number of the inflation packaging main body layer of the crossed staggered and stacked-type air packaging device can be two, three, or more. As an example of the present invention, in the following description, the number of the inflation packaging main body layers is two. Even so, one skilled in the art will understand that the number of the inflation packaging main body layers of the crossed staggered and stacked-type air packaging device is not limited to two. Hence, the following embodiments of the present invention are not intended to be limiting to the content and scope of the present invention.

Figure 10:
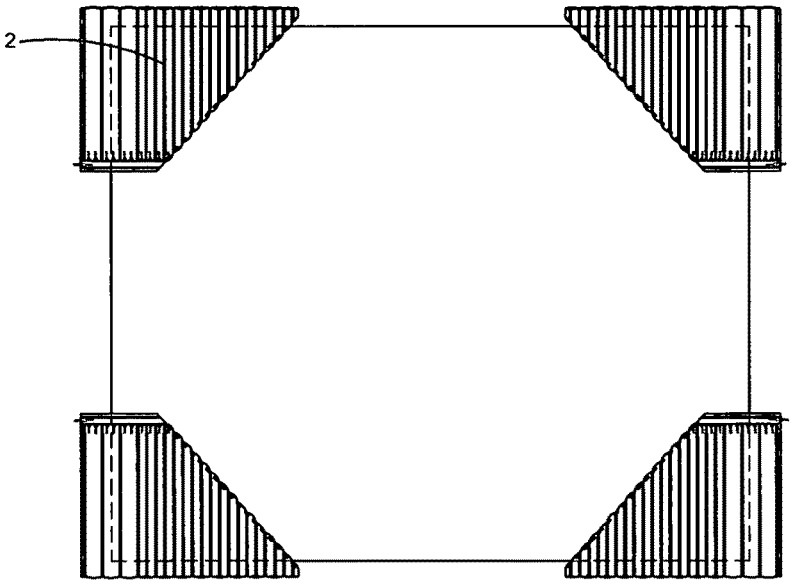
FIG. 10 illustrates an application method of the crossed staggered and stacked-type air packaging device according to the above preferred embodiment of the present invention.

In other words, as an example, the crossed staggered and stacked-type air packaging device comprises an inner inflation packaging main body layer 1 and an outer inflation packaging main body layer 2. The inner inflation packaging main body layer 1 and the outer inflation packaging main body layer 2 are arrange in a crossed stacking manner, so that the inner inflation packaging main body layer 1 and the outer inflation packaging main body layer 2 form a bag-in-bag structure. In other words, the outer inflation packaging main body layer 2 is stacked out of the inner inflation packaging main body layer 1. The inner inflation packaging main body layer 1 and the outer inflation packaging main body layer 2 are stacked together in a crossed and staggered manner. The inner inflation packaging main body layer 1 forms an accommodation cavity 100, so as to accommodate an article to be packaged, as shown in FIG. 10. One skilled in the art will understand that when the article is packaged to the accommodation cavity 100 formed by the crossed staggered and stacked-type air packaging device, all sides of the article are provided with at least two inflation packaging main body layers. For example, according to this preferred embodiment, all sides of the article are packaged by both the inner inflation packaging main body layer 1 and the outer inflation packaging main body layer 2, so as to enhance the cushion performance of the crossed staggered and stacked-type air packaging device.

It is worth mentioning that the variety of the article to be packaged is not limited according the present invention. The article can be but not limited to electronic products, food, medical products, chemical materials, biological materials, plastics, ceramics, FMCG (Fast Moving Consumer Goods), as so on. In the drawings, the article is illustrated as an electronic product, so as to help one skilled in the art to understand the content an essence of the present invention better. Hence, one skilled in the art will understand that the variety of the article illustrated above and in the drawings is not limitation to the content and scope of the present invention. According to actual requirement, the crossed staggered and stacked-type air packaging device can be used to package other kinds of articles. After the article is packaged by the crossed staggered and stacked-type air packaging device, the crossed staggered and stacked-type air packaging device has good plasticity. The shape and size of the accommodation cavity 100 can be adjusted automatically according to the external shape of the article, so that the crossed staggered and stacked-type air packaging device is packaged to the surface of the article, so as to effectively prevent the crossed staggered and stacked-type air packaging device from falling off due to some inartificial reasons, so that the crossed staggered and stacked-type air packaging device can be used to package the article together with other packaging items such as paper skin. The crossed staggered and stacked-type air packaging device can be used to package the article by itself without any other auxiliary materials.

According to some embodiments of the present invention, the inner inflation packaging main body layer 1 has an independent inflation structure, and the outer inflation packaging main body layer 2 has another independent inflation structure. In other words, either the inner inflation packaging main body layer 1 or the outer inflation packaging main body layer 2 is inflated with gas independently. While manufacturing the crossed staggered and stacked-type air packaging device, the inner inflation packaging main body layer 1 and the outer inflation packaging main body layer 2 are stacked together. The inner inflation packaging main body layer 1 and the outer inflation packaging main body layer 2 are connected to form the whole crossed staggered and stacked-type air packaging device by sealing the corresponding positions of the inner inflation packaging main body layer 1 and the outer inflation packaging main body layer 2 via a heat-sealing technology. While applying the crossed staggered and stacked-type air packaging device, the inner inflation packaging main body layer 1 and the outer inflation packaging main body layer 2 can be inflated independently, so that the inner inflation packaging main body layer 1 forms the accommodation cavity 100, and the outer inflation packaging main body layer 2 is stacked to the out of the inner inflation packaging main body layer 1 in a crossed manner.

According to some other embodiments of the present invention, the inner inflation packaging main body layer 1 and the outer inflation packaging main body layer 2 forms an integral structure. Relative to the above embodiments, the inner inflation packaging main body layer 1 and the outer inflation packaging main body layer 2 are integrally formed by an inflatable main body 10. In other words, the inner inflation packaging main body layer 1 and the outer inflation packaging main body layer 2 can be inflated with gas at the same time, so that the inner inflation packaging main body layer 1 forms the accommodation cavity 100 and that the outer inflation packaging main body layer 2 is stacked to the out of the inner inflation packaging main body layer 1 in a crossed manner. For example, referring to FIG. 3, FIG. 4A and FIG. 4B, according to this embodiment of the present invention, the inner inflation packaging main body layer 1 and the outer inflation packaging main body layer 2 are integrally formed by the inflatable main body 10, so as to reduce the steps of operating the crossed staggered and stacked-type air packaging device, especially the inflation steps while applying the crossed staggered and stacked-type air packaging device, so that the application is convenient. In the following description, the advantages of the present invention is adequately disclosed and illustrated by the following embodiments. According to the following embodiments, the inner inflation packaging main body layer 1 and the outer inflation packaging main body layer 2 are integrally formed by the inflatable main body 10. Even so, one skilled in the art will understand that whether the inner inflation packaging main body layer 1 and the outer inflation packaging main body layer 2 are embodied in which manner, the inner inflation packaging main body layer 1 and the outer inflation packaging main body layer 2 are stacked in a crossed and staggered manner, so as to enhance the cushion performance of the crossed staggered and stacked-type air packaging device.

Figure 1:
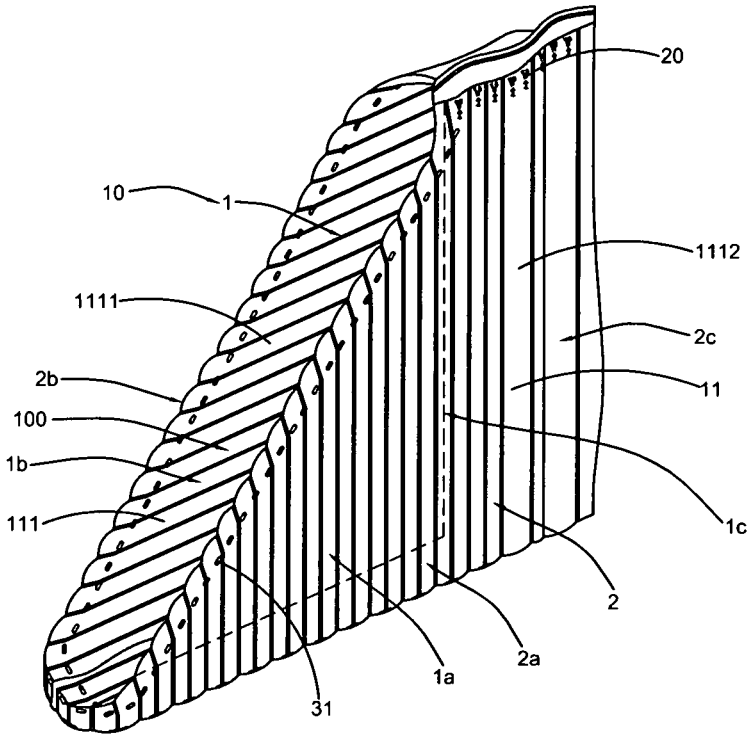
FIG. 1 is a perspective view of a crossed staggered and stacked-type air packaging device according to a preferred embodiment of the present invention.
Figure 2:
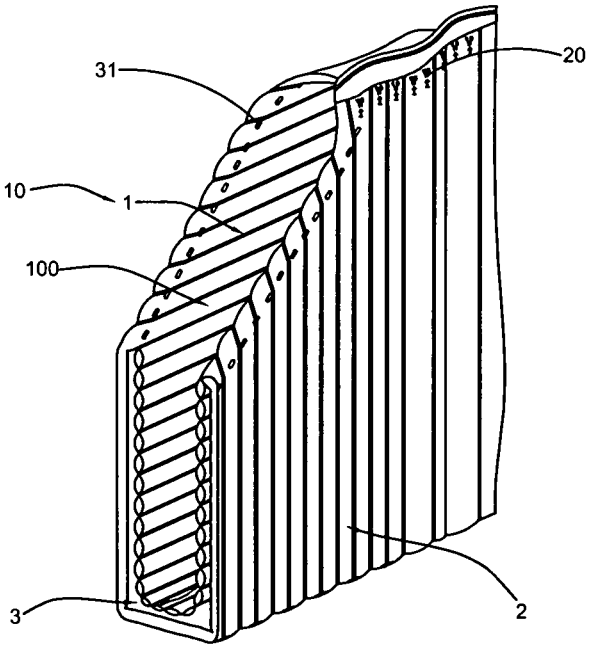
FIG. 2 is a sectional view of the crossed staggered and stacked-type air packaging device according to the above preferred embodiment of the present invention.
Figure 3:
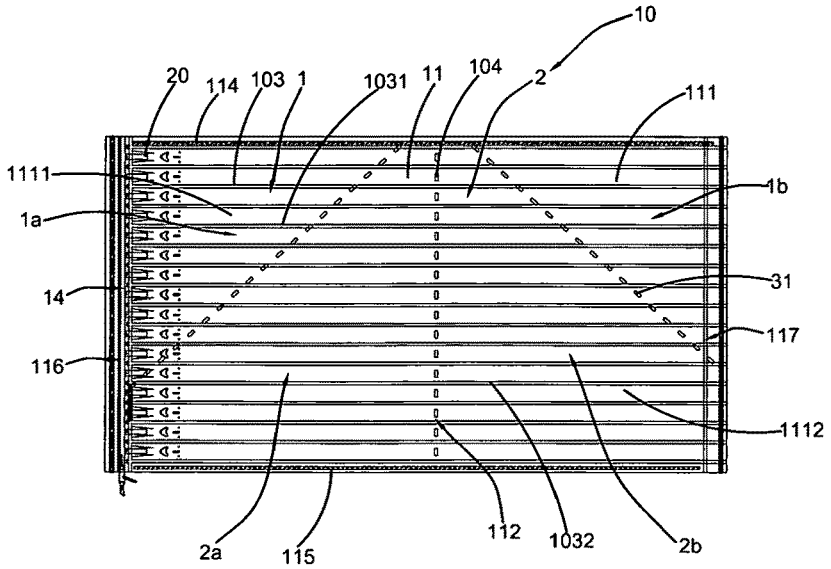
FIG. 3 illustrates an unfolded state of the crossed staggered and stacked-type air packaging device according to the above preferred embodiment of the present invention before the crossed staggered and stacked-type air packaging device is inflated.
Figure 4A:
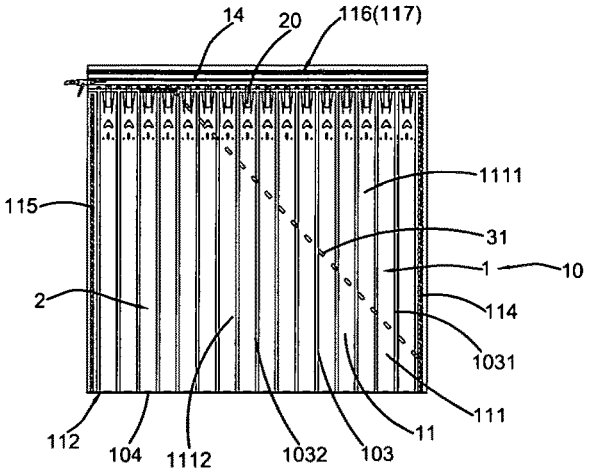
FIG. 4A illustrates a state of the crossed staggered and stacked-type air packaging device according to the above preferred embodiment of the present invention after the crossed staggered and stacked-type air packaging device is folded and heat-sealed.
Figure 4B:
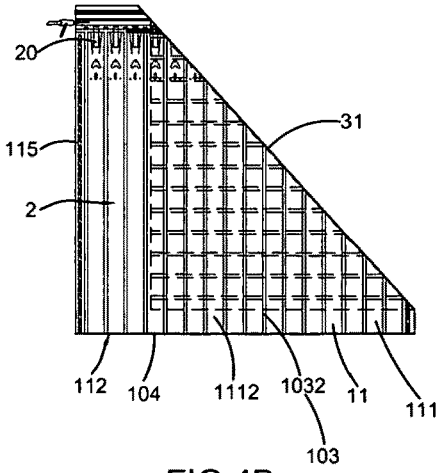
FIG. 4B illustrates another state of the crossed staggered and stacked-type air packaging device according to the above preferred embodiment of the present invention after the crossed staggered and stacked-type air packaging device is folded and heat-sealed.

In detail, according to this preferred embodiment of the present invention, the inner inflation packaging main body layer 1 and the outer inflation packaging main body layer 2 are arranged in a crossed and staggered stacking manner. In more detail, referring to FIG. 16, the inflatable main body 10 comprises at least one inflation unit 11. The inflation unit 11 comprises a first chamber layer 101 and a second chamber layer 102. The first chamber layer 101 and the second chamber layer 102 can be embodied as but not limited to two layers of flexibility thin films. The first chamber layer 101 and the second chamber layer 102 overlap with each other, so as to form an inflation cavity 12 and at least one inflation opening 13. The inflation opening 13 communicates with the inflation cavity 12, so as to be used to inflate gas into the inflation cavity 12. Referring to FIG. 3 and FIG. 4B, two or more inflation units 11 are arranged side by side and connect with each other, so as to form the inflatable main body 10. Each inflation unit 11 is provided with at least one inflation valve 20. Each inflation unit 11 can be inflated independently. An extended dividing seam 103 is provided between adjacent inflation units 11. According the some embodiments, each dividing seam 103 can be embodied as a heat-sealing seam between adjacent inflation units 11, so that the inflation cavity 12 is divided into a plurality of independent inflation cavities 12 via the dividing seams 103. Thus, if any inflation unit 11 is damaged to leak gas, other inflation units 11 will not be involved. In other words, other inflation units 11 still can provide cushion effect to the article being packaged. It is worth mentioning that the inflation units 11 can be provided to communicate with each other. Thus, only one inflation valve 20 is enough to be used to inflate gas into all of the inflation units 11. In other words, according to some embodiments of the present invention, the crossed staggered and stacked-type air packaging device can form a plurality of inflation units 11 by heat sealing the first chamber layer 101 and the second chamber layer 102 overlapped with each other. It is worth mentioning that if the inner inflation packaging main body layer 1 and the outer inflation packaging main body layer 2 are integrally formed by the inflatable main body 10, the inflation valve 20 can be provided to the inner inflation packaging main body layer 1 or to the outer inflation packaging main body layer 2. According to the present invention, the providing position of the inflation valve 20 is not limited.

In addition, due to the shape of each inflation unit 11 can change after the inflation unit 11 is inflated with gas, the inflatable main body 10 can be made to have varies of shapes and sizes. The shape of the inflation unit 11 can be strip (such as crosswise strip and/or lengthways strip), bulk. The shape of the inflation unit 11 is not limited. According to this preferred embodiment, the shape of the inflation unit 11 is strip. According to this preferred embodiment of the present invention, the inflatable main body 10 forms a main channel 14 communicating with the inflation opening 13. The main channel 14 communicates with each inflation unit 11 through one or more inflation valves 20. Thus, while air is inflated through the inflation opening 13, air enters into the main channel 14 first through the inflation opening 13, and then air guided by the main channel 14 and enters into corresponding inflation cavities 12 through the inflation valves 20, so that air enters into each inflation unit 11. In other words, the main channel 14 can be an air distribution channel used to distribute air through the inflation opening 13 into each inflation unit 11. Furthermore, an inflation mouth can be provided to the inflation opening 13. The inflation mouth can be used to connect with an inflation device such as an inflation pump. Thus, the inner inflation packaging main body layer 1 and the outer inflation packaging main body layer 2 of the crossed staggered and stacked-type air packaging device is inflated with gas by the cooperation of the inflation device and the inflation mouth.

It is worth mentioning that, according to other embodiments of the present invention, if the inner inflation packaging main body layer 1 and the outer inflation packaging main body layer 2 are embodied as having independent inflation structure, the inner inflation packaging main body layer 1 and the outer inflation packaging main body layer 2 can be respectively inflated in the similar manner. Even so, one skilled in the art will understand that other inflation methods of inflating the crossed staggered and stacked-type air packaging device are permitted. The methods which are not illustrated will not affect the content and scope of the present invention.

Each inflation unit 11 of the inflatable main body 10 has a plurality of bending seams 104, so that each inflation unit 11 further forms a plurality of corresponding sub-inflation units 111. It is worth mentioning that the position of each bending seam 104 of the inflation units 11 is corresponded. In other words, the inflatable main body 10 has more than one line of bending seams 104. A space is provided between two adjacent lines of bending seams 104. The bending seams 104 provided to the inflation unit 11 are arranged as lines, but each bending seam 104 is not connected with another bending seam 104, so that a side wall and/or a bottom wall of the crossed staggered and stacked-type air packaging device can be formed between two adjacent lines of bending seams 104. The side wall and/or the bottom wall define the accommodation cavity 100 used to accommodate the article to be packaged. In other words, the inflatable main body 10 has more than one line of bending seams 104 being used to bend. The bending seams 104 are arranged as nodal lines with space between them, so that the inflatable main body 10 forms a plurality of chamber side walls and/or bottom walls after being bended along the bending seams 104.

In detail, referring to FIG. 3, the inflatable main body 10 comprises a line of bending seams 104. In other words, each inflation unit 11 forms two corresponding sub-inflation units 111. The inflatable main body 10 is bended along the bending seams 104, so that the inflatable main body 10 forms side walls of the crossed staggered and stacked-type air packaging device. According to the embodiment illustrated in FIG. 5 to FIG. 8, the inflatable main body 10 has two lines of bending seams 104, so that each inflation unit 11 forms three sub-inflation units 111. The inflatable main body 10 is bended along each line of bending seams 104, so that the inflatable main body 10 forms the side wall and the bottom wall of crossed staggered and stacked-type air packaging device in corresponding positions. One skilled in the art will understand, the inflatable main body 10 can comprise more lines of bending seams 104 (not illustrated in the drawings) according to actual requirements. For example, if the inflatable main body 10 is provided with three lines of bending seams 104, the inflatable main body can form a cover body which can close the cavity opening of the accommodation cavity 100. The different numbers of the lines of the bending seams 104 make the crossed staggered and stacked-type air packaging device to be suitable to package more kinds of articles. Hence, one skilled in the art will understand that the number of the lines of the bending seams 104 in this preferred embodiment of the present invention will not limit the content and scope of the present invention.

Furthermore, the inflatable main body 10 has more than one line of turning seams 31, according to the preferred embodiment illustrated in FIG. 3. The turning seam 31 is aslant extended to each inflation unit 11, so that the inflation unit 11 can be bended to turn along the turning seam 31, so that the inflatable main body 10 forms the inner inflation packaging main body layer 1 and the outer inflation packaging main body layer 2 of the crossed staggered and stacked-type air packaging device. One skilled in the art will understand that before inflatable main body 10 is bended, each inflation unit 11 of the inflatable main body 10 extends in a same direction, referring to FIG. 4A. After the inflatable main body 10 is bended along the turning seam 31 to turn, each inflation unit 11 forms at least one inner inflation unit 1111 and at least one outer inflation unit 1112. It is understandable that the inner inflation units 1111 are arranged to form the inner inflation packaging main body layer 1. The outer inflation unit 1112 are arranged to form the outer inflation packaging main body layer 2. The extending direction of each inner inflation unit 1111 of the inner inflation packaging main body layer 1 is different from the extending direction of each outer inflation unit 1112 of the outer inflation packaging main body layer 2. The inner inflation packaging main body layer 1 defines the accommodation cavity 100 used which is used to accommodate the article to be packaged.

It is understandable that, in such a manner, the crossed staggered and stacked-type air packaging device forms an air packaging body with a roughly triangle spatial configuration. Hence, the crossed staggered and stacked-type air packaging device is suitable to be used to package the corner of the article. For example, in the application of the crossed staggered and stacked-type air packaging device illustrated in FIG. 10, a plurality of (four) crossed staggered and stacked-type air packaging devices work together to be provided to four corners of the article, so as to realize the packaging to the article.

It is worth mentioning that not all of the inflation units 11 are provided with the turning seam 31. For example, the inflation units 11 at one side of the inflatable main body 10 are provided with the turning seams 31. The inflation units 11 at the other side of the inflatable main body 10 are not provided with the turning seams 31. Hence, after the inflatable main body 10 is bended along these turning seams 31, the inner inflation packaging main body layer 1 hangs or partially hangs to the outer inflation packaging main body layer 2, so as to enhance the cushion performance of the crossed staggered and stacked-type air packaging device. It is understandable that, according to other embodiments of the present invention, all of the inflation units 11 can be provided with the turning seams 31, so as to form the crossed staggered and stacked-type air packaging device with different types and sizes.

It is worth mentioning that the inclination angle of the turning seam 31 will affect the shape and size of the inner inflation packaging main body layer 1 and the outer inflation packaging main body layer 2. For example, according to the embodiment illustrated in FIG. 3, the angle between the turning seam 31 and the bending seams 104 is roughly 45°, so that the inner inflation packaging main body layer 1 formed by the inflatable main body 10 has a roughly 90° corner. Thus, the crossed staggered and stacked-type air packaging device formed by the inflatable main body 10 is suitable to be used to package the articles having a vertical corner, and the extending direction of the inner inflation unit 1111 of the inner inflation packaging main body layer 1 is roughly vertical with the extending direction of the outer inflation unit 1112 of the outer inflation packaging main body layer 2.

Even so, one skilled in the art will understand, according to actual requirements, the angle between the extending direction of the turning seam 31 and the extending direction of the bending seams 104 can be bigger or smaller, so that the accommodation cavity 100 defined by the inner inflation packaging main body layer 1 formed by the inflatable main body 10 is suitable to be used to accommodate articles with other shapes. Hence, one skilled in the art will understand that the angle between the extending direction of the turning seam 31 and the extending direction of the bending seams 104 is bigger than 0° and smaller than 90°, so as to ensure the inner inflation unit 1111 of the inner inflation packaging main body layer 1 can be crossed and staggered stacked with the outer inflation unit 1112 of the outer inflation packaging main body layer 2, so as to signally enhance the cushion performance of the crossed staggered and stacked-type air packaging device.

It is worth mentioning that each line of the turning seams 31 is symmetrically provided to two sides of the bending seam 104. Thus, after the inflatable main body 10 is bended along the bending seams 104 and the turning seam 31, the structures in the two sides of the bending seams 104 is the same, so as to form the crossed staggered and stacked-type air packaging device having the accommodation cavity 100 with a regular shape.

It is worth mentioning that, according to other embodiments of the present invention, the inflatable main body 10 can comprise more lines of turning seams 31, so that the accommodation cavity 100 with different shape and size can be formed by the inflatable main body 10. Such embodiments will be introduced in detail in the following description. In addition, the bending seams 104 and the turning seams 31 have not separated adjacent sub-inflation units 111. In other words, at least one communication channel 112 is formed between adjacent sub-inflation units 111, so that while air is inflated through the inflation opening 13, the air will enter into each sub-inflation unit 111 of each inflation unit 11 through the communication channel 112. According to the embodiment illustrated in FIG. 3, the center between adjacent sub-inflation units 111 is provided with the bending seam 104 and the turning seam 31 which are heat-sealed. The communication channels 112 are formed to two sides of the bending seam 104 and two sides of the turning seam 31. According to other embodiments of the present invention, the turning seam 31 and the bending seam 104 can heat-sealed to two sides of the sub-inflation units 111, so that the communication channel 112 is formed to the center.

Referring to FIG. 3, the sub-inflation units 111 further forms the inner inflation unit 1111 of the inner inflation packaging main body layer 1 and the outer inflation unit 1112 of the outer inflation packaging main body layer 2, and the inner inflation packaging main body layer 1 forms a front side wall 1*a*, a rear side wall 1*b*, and a right side wall 1*c*. The front side wall 1*a*, the rear side wall 1*b*, and the right side wall 1*c* of the inner inflation packaging main body layer 1 defines the accommodation cavity 100, so as to accommodate the article to be packaged. Correspondingly, the outer inflation packaging main body layer 2 forms a front side wall 2*a*, a rear side wall 2*b*, and a right side wall 2*c*. Thus, the front side wall 1*a*, the rear side wall 1*b*, and the right side wall 1*c* from by the inner inflation packaging main body layer 1 are stacked with the front side wall 2*a*, the rear side wall 2*b*, and the right side wall 2*c* formed by the outer inflation packaging main body layer 2, so as to form a stacked structure. Thus, after the article is accommodated within the accommodation cavity 100, any side of the article is packaged by side walls formed by the inner inflation packaging main body layer 1 and the outer inflation packaging main body layer 2. Take the right side of the article as an example, the right side wall 1*c* formed by the inner inflation packaging main body layer 1 and the right side wall 2*c* formed by the outer inflation packaging main body layer 2 are crossed and staggered stacked to the right side of the article, so as to enhance the cushion performance of the crossed staggered and stacked-type air packaging device. One skilled in the art will understand that the extending direction of the inner inflation unit 1111 of the inner inflation packaging main body layer 1 forming the right side wall 1*c* is different from the extending direction of the outer inflation unit 1112 of the outer inflation packaging main body layer 2 forming the right side wall 2*c*.

Correspondingly, after the inflatable main body 10 is bended along the turning seam 31 to turn, the dividing seam 1031 of the inner inflation packaging main body layer 1 extends in the same direction with extending direction of the dividing seam 1032 of the outer inflation packaging main body layer 2. In other words, according to this preferred embodiment of the present invention, the dividing seams 103 comprise the dividing seam 1031 of the inner inflation packaging main body layer 1 and the dividing seam 1032 of the outer inflation packaging main body layer 2. According to this preferred embodiment of the present invention, at the un-inflated and unfolded state, dividing seam 1031 of the inner inflation packaging main body layer 1 extends in the same direction with extending direction of the dividing seam 1032 of the outer inflation packaging main body layer 2. The dividing seam 1031 and the dividing seam 1032 can be formed by one heat-sealing step. One skilled in the art will understand that when the inflatable main body 10 is bended along the turning seam 31 to turn, the extending direction of the dividing seam 1031 of the inner inflation packaging main body layer 1 changes accordingly.

It is worth mentioning that due to the inner inflation packaging main body layer 1 is formed within the outer inflation packaging main body layer 2, the crossed staggered and stacked-type air packaging device forms a bag-in bag structure. In other words, the inner inflation packaging main body layer 1 is provided inside and defines the accommodation cavity 100 being used to accommodate the article. The outer inflation packaging main body layer 2 is provided outside and is crossed stacked outside the inner inflation packaging main body layer 1. At least one dividing seam 1031 of the inner inflation packaging main body layer 1 is crossed stacked with at least two outer inflation units 1112 of the outer inflation packaging main body layer 2. For example, according to the embodiment illustrated in FIG. 3, each dividing seam 1031 of the inner inflation packaging main body layer 1 is covered by each outer inflation unit 1112 of the outer inflation packaging main body layer 2. Hence, when the heat is conducted and radiated to each diving seam 1031 of the inner inflation packaging main body layer 1, the heat will be blocked by the air in the outer inflation unit 1112 of the outer inflation packaging main body layer 2, so as to prevent the heat being transmitted. Hence, the crossed staggered and stacked-type air packaging device according to the present invention is suitable to be applied to articles need to retain heat.

When the crossed staggered and stacked-type air packaging device is applied to package an article, the accommodation cavity 100 formed by the inner inflation packaging main body layer 1 is applied to hold the article, so as to enhance the cushion performance of the crossed staggered and stacked-type air packaging device.

In detail, while the article packaged to the crossed staggered and stacked-type air packaging device being transporting, the whole crossed staggered and stacked-type air packaging device waggles due to receiving some shock. Due to the pulling by the outer inflation packaging main body layer 2 packaged out of the inner inflation packaging main body layer 1, the article will not be concentrated to a partial position. In more detail, for example, if the article tends to waggle to the right corner in the accommodation cavity 100, the article will return to the initial position due to the dragging of the outer inflation packaging main body layer 2, because the left side edge of the inner inflation packaging main body layer 1 is connected to the outer inflation packaging main body layer 2 which is packaged to the inner inflation packaging main body layer 1. In other words, the article accommodated in the accommodation cavity 100 of the inner inflation packaging main body layer 1 can be kept to a permanent position and keeps a predetermined distance with the outer inflation packaging main body layer 2 packaged to the inner inflation packaging main body layer 1 but not contact with the outer inflation packaging main body layer 2 directly. Hence, the impact stress acted to the outer inflation packaging main body layer 2 is further dispersed by the sealed chamber formed by the inner inflation unit 1111 and the outer inflation unit 1112, a cushion space between the inner inflation packaging main body layer 1 and the outer inflation packaging main body layer 2, and the impact stress will not be directly transmitted to the article from the sealing chamber of the outer inflation packaging main body layer 2.

It is worth mentioning that due to the inner inflation packaging main body layer 1 and the outer inflation packaging main body layer 2 of the crossed staggered and stacked-type air packaging device are arranged in a stacked manner, the cushion space is form between the inner inflation packaging main body layer 1 and the outer inflation packaging main body layer 2. There is some air remained in the cushion space. If the outer inflation packaging main body layer 2 is stroke and impacted, the cushion space together with the air therein form a layer of chamber structure 3. The chamber structure 3 provides a cushion action, and separates the article with the sealed chamber of the outer inflation packaging main body layer 2, so as to prevent the impact stress applied to the outer inflation packaging main body layer 2 from being directly transmitted the article in the accommodation cavity 100. Thus, the cushion performance between the inner inflation packaging main body layer 1 and the outer inflation packaging main body layer 2 evidently enhances the cushion packaging performance of the crossed staggered and stacked-type air packaging device.

In addition, according to some embodiment of the present invention, after the inflatable main body 10 forms the inner inflation packaging main body layer 1 and the outer inflation packaging main body layer 2, the inner inflation packaging main body layer 1 is suspended within the outer inflation packaging main body layer 2, so as to further enhance the cushion packaging action of the crossed staggered and stacked-type air packaging device, so as to ensure the safety of the article while the article is transporting.

It is worth mentioning that, due to the inner inflation packaging main body layer 1 is crossed and staggered into the outer inflation packaging main body layer 2, the reliability of the crossed staggered and stacked-type air packaging device is enhanced. For example, if one inflation unit 11 is damaged, the outer inflation packaging main body layer 2 and the inner inflation packaging main body layer 1 still have a single layer of cushion structure near the damaged inflation unit 11 due to the crossed staggered and stacked structure is applied, so that the crossed staggered and stacked-type air packaging device still has inflation cushion performance. Hence, the crossed staggered and stacked-type air packaging device has remarkable improvement relative to the air packaging device according to the traditional art.

In addition, the inner inflation packaging main body layer 1 can be connected via an inner connection seam 114, so as to define the accommodation cavity 100. Correspondingly, the outer inflation packaging main body layer 2 can be connected by an outer connection seam 115 outer inflation packaging main body layer 2. The inner connection seam 114 and the outer connection seam 115 can be formed via heat sealing technology. Thus, when the inner inflation packaging main body layer 1 is bended along the turning seam 31, the inner inflation packaging main body layer 1 and the outer inflation packaging main body layer 2 are arranged in a stacked manner, and the cushion space is formed between the inner inflation packaging main body layer 1 and the outer inflation packaging main body layer 2, so that the crossed staggered and stacked-type air packaging device has strong elastic restoring force, so as to enhance the cushion packaging performance of the crossed staggered and stacked-type air packaging device.

In detail, the inner connection seam 114 and the outer connection seam 115 are respectively provided to two sides of the inflatable main body 10. The inner connection seam 114 and the outer connection seam 115 can be formed by respectively heat sealing the first chamber layer 101 and the second chamber layer 102 at two sides of the inflatable main body 10. For example, before the inflation unit 11 is inflated, the inflatable main body 10 is bended along the bending seam 104, and the inflatable main body 10 is heat sealed along two edge positions, so as to form the inner connection seam 114 and the outer connection seam 115 at the same time. Referring to FIG. 4B, part of the inflatable main body 10 is bended along the turning seam 31 to turn, so as to form the inner inflation packaging main body layer 1 and the outer inflation packaging main body layer 2. The inner connection seam 114 is provided, so that the inner inflation packaging main body layer 1 forms the front side wall 1*a* and the rear side wall 1*b*, so that the front side wall 1*a* together with the rear side wall 1*b* defines the accommodation cavity 100. Correspondingly, the outer connection seam 115 is provided, so that the outer inflation packaging main body layer 2 forms the front side wall 2*a*, the rear side wall 2*b* and the right side wall 2*c*. The positions of the front side wall 2*a* and the rear side wall 2*b* are respectively corresponding with the positions of the front side wall 1*a* and the rear side wall 1*b* of the inner inflation packaging main body layer 1. The right side wall 2*c* is packaged to the side position of the inner inflation packaging main body layer 1, so that the outer inflation packaging main body layer 2 is packaged outside the inner inflation packaging main body layer 1, so that the inner inflation packaging main body layer 1 and the outer inflation packaging main body layer 2 forms the inner inflation packaging main body layer 1 stacked structure.

It is worth mentioning that the outer connection seam 115 is provided between two outer inflation units 1112. Thus, referring to FIG. 9B, after the crossed staggered and stacked-type air packaging device is formed, the cushion packaging performance of the side portion of the outer inflation packaging main body layer 2 is enhanced. According to some embodiments of the present invention, the size of the diameter of the sub-inflation units 111 of the inner inflation unit 1111 and the outer inflation unit 1112 can be equal or unequal. In other words, the inner inflation packaging main body layer 1 and the outer inflation packaging main body layer 2 can be provided with sub-inflation units 111 with the same diameter of with different diameters. According to the embodiment illustrated in FIG. 1, the side portion of the outer inflation packaging main body layer 2 outer inflation packaging main body layer 2 is provided with one or more big sub-inflation units 111. In other words, the diameters of the sub-inflation units 111 of the outer inflation packaging main body layer 2 can be different with each other. The outer connection seam 115 is provided between two big sub-inflation units 111. One skilled in the art will understand the outer connection seam 115 can be embodied as a heat sealing seam provided between two sub-inflation units 111. In other words, the outer connection seam 115 can be formed together with the dividing seam 103. Hence, one skilled in the art will understand that each dividing seam 103 can be formed earlier, and the outer connection seam 115 is formed later. There is no limitation in this aspect.

In such a manner, when the inner inflation packaging main body layer 1 and the outer inflation packaging main body layer 2 form the crossed staggered and stacked-type air packaging device, there is no spare portion of the inflatable main body 10 is provide to the corner of the outer inflation packaging main body layer 2. In other words, while the outer inflation packaging main body layer 2 is heat sealed, the corner of the crossed staggered and stacked-type air packaging device is formed in a gradually changing manner. According to the embodiments illustrated in FIG. 7, FIG. 8 and FIG. 9A, an un-inflatable portion or other structure can be formed to the corner of the outer inflation packaging main body layer 2, and after the inner inflation packaging main body layer 1 and the outer inflation packaging main body layer 2 are crossed and stacked arranged to form the crossed staggered and stacked-type air packaging device, a plurality of bending units 40 is formed to the corner of the crossed staggered and stacked-type air packaging device. The bending units 40 will be further described in the following description. It is worth mentioning that the cushion space formed by the inner inflation packaging main body layer 1 and the outer inflation packaging main body layer 2 can be sealed space or non-sealed space. One skilled in the art will understand that no matter that which type of cushion space is the cushion space embodied as, the performance of cushion space to enhance the cushion performance of the inner inflation packaging main body layer 1 and the outer inflation packaging main body layer 2 will not be affected.

In addition, the inflatable main body 10 further comprises a main channel sealing seam 116 and a top sealing seam 117. The main channel sealing seam 116 and the top sealing seam 117 respectively seal the edges of two layers of the inflatable main body 10. In the manufacturing process of the crossed staggered and stacked-type air packaging device, the main channel sealing seam 116 and the top sealing seam 117 can be formed by once heat sealing. According to this preferred embodiment, the inner inflation packaging main body layer 1 is heat sealed together via the main channel sealing seam 116 and the top sealing seam 117. The heat seal position is provided to the right side wall 1*c* of the inner inflation packaging main body layer 1. Thus, the position of the right side wall 1*c* formed by the inner inflation packaging main body layer 1 is corresponding with the position of the right side wall 2*c* of the outer inflation packaging main body layer 2.

Figure 5:
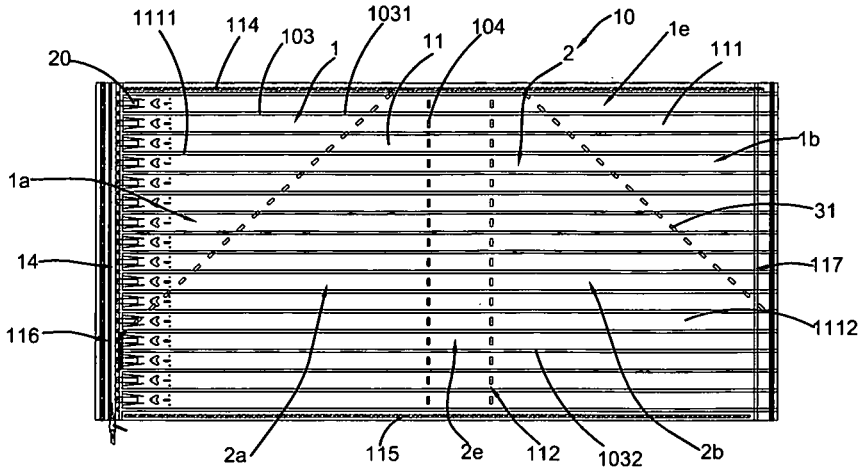
FIG. 5 illustrates an unfolded state of a crossed staggered and stacked-type air packaging device according to an alternative mode of the above preferred embodiment of the present invention before the crossed staggered and stacked-type air packaging device is inflated.

According to an alternative mode of this preferred embodiment of the present invention, referring to FIG. 5, the inflatable main body 10 can comprise two lines of bending seams 104, so that when the inflatable main body 10 is bended along the bending seam 104 to form the inner inflation packaging main body layer 1 and the outer inflation packaging main body layer 2, the inner inflation packaging main body layer 1 also forms a bottom wall 1*d*. Correspondingly, the outer inflation packaging main body layer 2 also forms a bottom wall 2*e*. The bottom wall 1*d* of the inner inflation packaging main body layer 1 is corresponding with the bottom wall 2*e* of the outer inflation packaging main body layer 2. Thus, the accommodation cavity 100 defined by the front side wall 1*a*, the rear side wall 1*b*, the right side wall 1*c* and the bottom wall 1*d* has a regular shape. When the article such as a displayer is accommodated within the accommodation cavity 100, the article will not be pressed due the change of the shape of the accommodation cavity 100.

Figure 6:
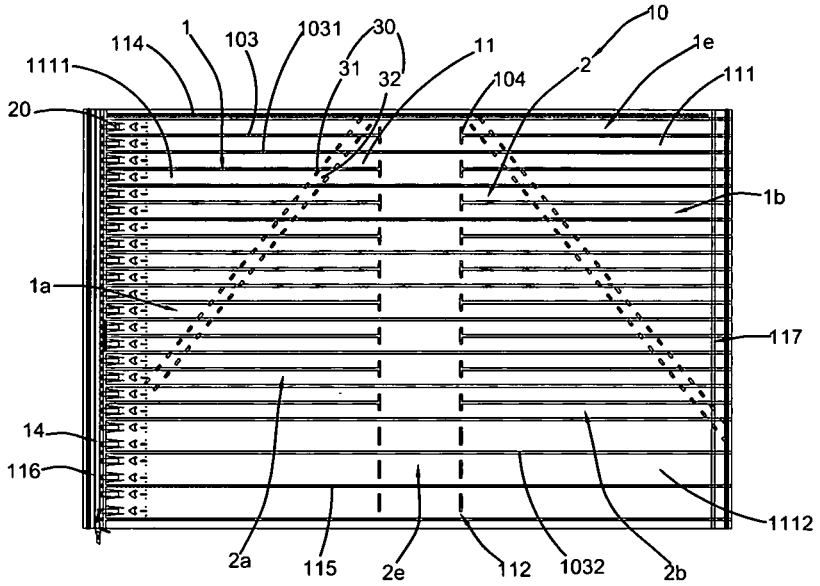
FIG. 6 illustrates an unfolded state of a crossed staggered and stacked-type air packaging device according to another alternative mode of the above preferred embodiment of the present invention before the crossed staggered and stacked-type air packaging device is inflated.

According to another alternative mode of this preferred embodiment of the present invention, referring to FIG. 6, the inflatable main body 10 can comprise more lines of bending seams 104. For example, each two lines of turning seams 31 are paralleledly and aslant extended to each inflation unit 11 is bended along the turning seam 31 to turn. Thus, the inflatable main body 10 forms a turning portion 30 integrally connecting with the inner inflation packaging main body layer 1 and the outer inflation packaging main body layer 2. In other words, the turning portion 30 comprises a plurality of turning seams 31 extended between adjacent turning seams 31. Thus, when the inflatable main body 10 is bended along the turning portion 30 to form the inner inflation packaging main body layer 1 and the outer inflation packaging main body layer 2, the thickness of the cavity opening of the accommodation cavity 100 defined by the inner inflation packaging main body layer 1 can be ensured. In other words, each turning inflation unit 32 forms the thickness of the cavity opening of the accommodation cavity 100, so as to ensure the safety of the article packaged by the crossed staggered and stacked-type air packaging device in the transporting process.

According to the embodiment illustrated in FIG. 7 to FIG. 9C, the outer inflation packaging main body layer 2 further comprises two bending units 40. The bending units 40 are respectively provided to two corners of the crossed staggered and stacked-type air packaging device, so that the corners of the crossed staggered and stacked-type air packaging device can be bended easily, so as to form a spatial configuration easily. The bottom wall of the crossed staggered and stacked-type air packaging device formed in such a manner is roughly vertical with the side walls, so that a regular accommodation space is formed by the bottom wall and the side walls, so that the crossed staggered and stacked-type air packaging device is suitable to be applied to package articles with roughly square shapes.

Figure 7:
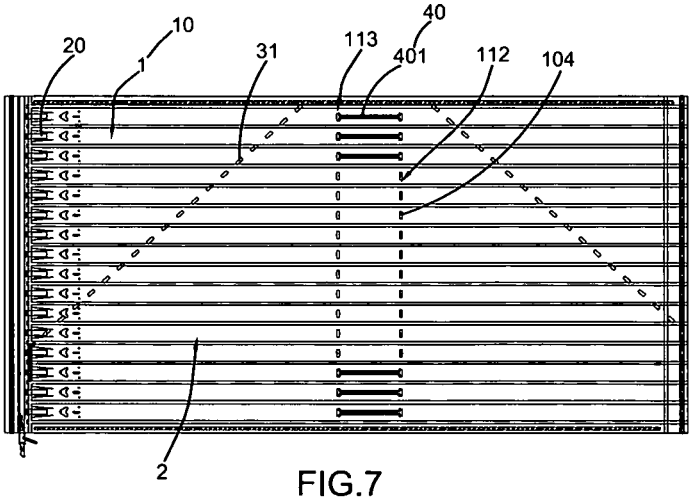
FIG. 7 illustrates an unfolded state of a crossed staggered and stacked-type air packaging device according to another alternative mode of the above preferred embodiment of the present invention before the crossed staggered and stacked-type air packaging device is inflated.

According to some embodiments of the present invention, referring to FIG. 7, each bending unit 40 can be formed by providing a plurality of air rejecting seams 401 to the sub-inflation units 111. The air rejecting seams 401 are provided to reduce the inflating volume of the corresponding sub-inflation units 111, so that the whole bending units 40 can be bended easily. The air rejecting seams 401 can be formed in a heat sealing manner, and the shape, size and position of the air rejecting seams 401 are not limited. For example, each air rejecting seam 401 can be a plurality of crosswise or lengthways heat sealing lines of heat sealing bulks.

Figure 8:
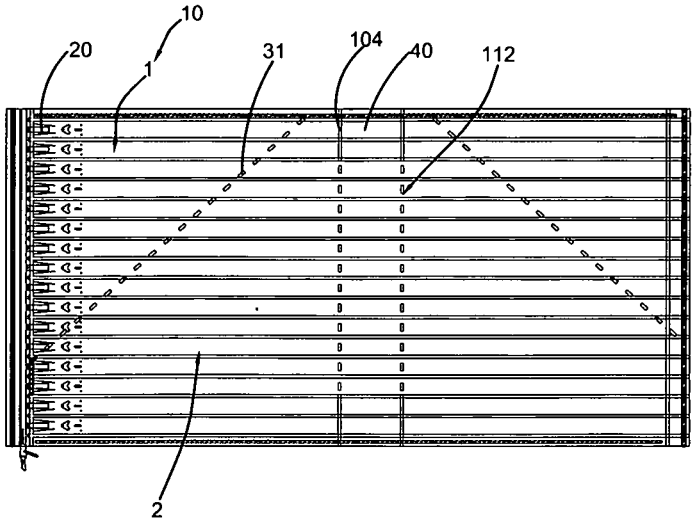
FIG. 8 illustrates an unfolded state of a crossed staggered and stacked-type air packaging device according to a fourth alternative mode of the above preferred embodiment of the present invention before the crossed staggered and stacked-type air packaging device is inflated.
Figure 9A:
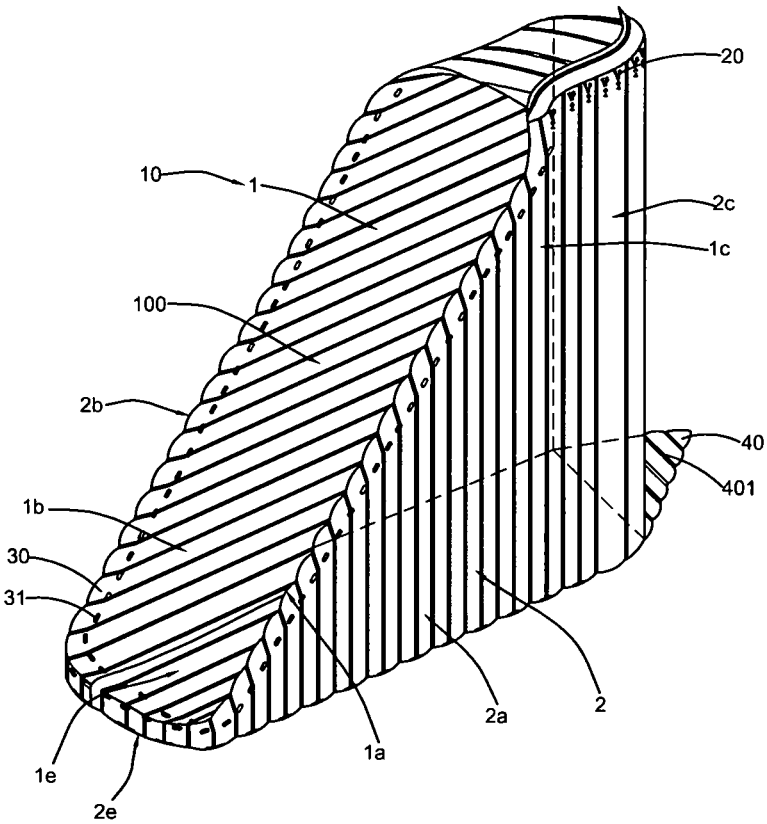
FIG. 9A is a perspective view of the crossed staggered and stacked-type air packaging device according to the above preferred embodiment of the present invention, illustrating a state of the crossed staggered and stacked-type air packaging device after being inflated.
Figure 9B:
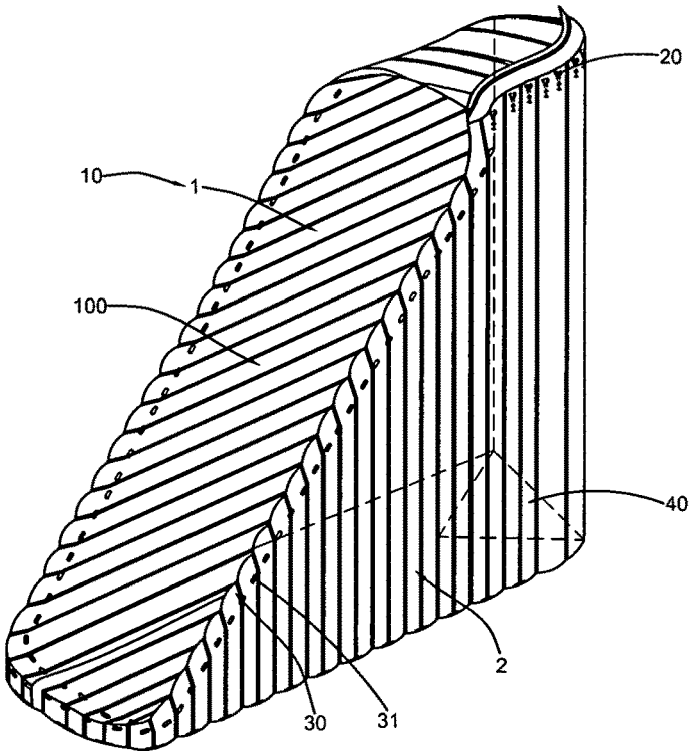
FIG. 9B is another perspective view of the crossed staggered and stacked-type air packaging device according to the above preferred embodiment of the present invention, illustrating another state of the crossed staggered and stacked-type air packaging device after being inflated.
Figure 9C:
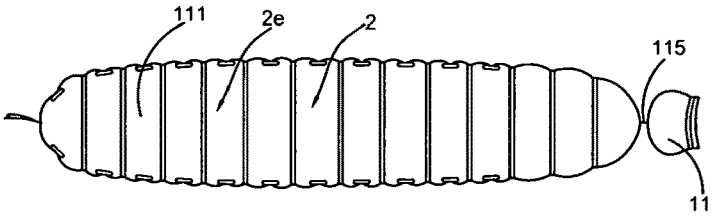
FIG. 9C is a bottom view of the crossed staggered and stacked-type air packaging device according to the above preferred embodiment of the present invention after the crossed staggered and stacked-type air packaging device is inflated.

According to some other embodiments of the present invention, referring to FIG. 8, the bending units 40 can be un-inflatable units. A secondary communicating channel 113 is provided to distribute gas. In other words, when the inflation opening 13 is applied to inflate to the crossed staggered and stacked-type air packaging device, gas can enter into each inflation unit 11 through the communicating channel 112 and the secondary communicating channel 113. The bending unit 40 can be bulged out of the crossed staggered and stacked-type air packaging device as illustrated in FIG. 9A, FIG. 9B and FIG. 9C, or be plugged within the crossed staggered and stacked-type air packaging device as illustrated in FIG. 9B.

It is worth mentioning that, according to the present invention, the size of the inner inflation unit 1111 forming the inner inflation packaging main body layer 1 can be equal to or un-equal to the size of the outer inflation unit 1112 forming the outer inflation packaging main body layer 2. There is no limitation in this aspect.

Figure 11:
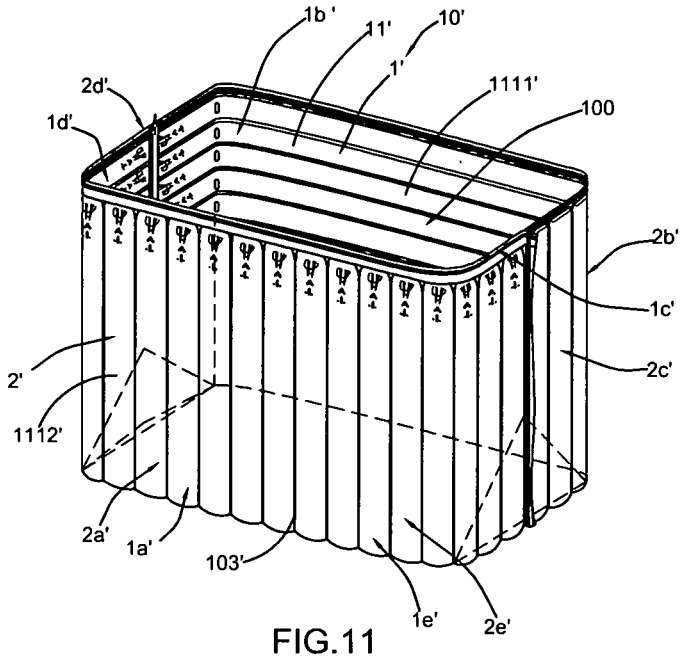
FIG. 11 is a perspective view of a crossed staggered and stacked-type air packaging device according to another preferred embodiment of the present invention.
Figure 12:
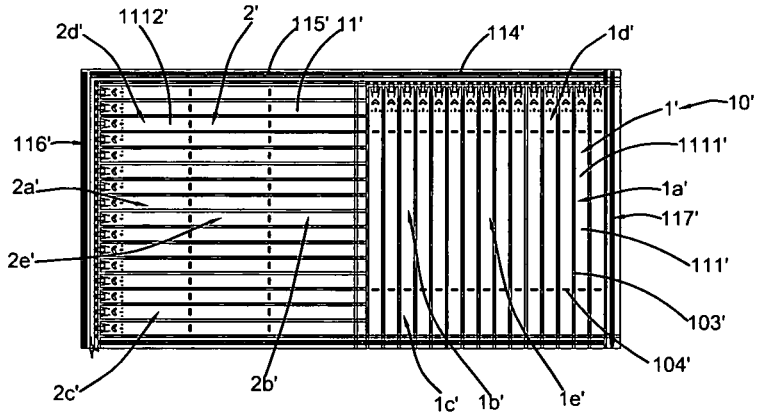
FIG. 12 illustrates an unfolded state of the crossed staggered and stacked-type air packaging device according to the above another preferred embodiment of the present invention before the crossed staggered and stacked-type air packaging device is inflated.
Figure 13:
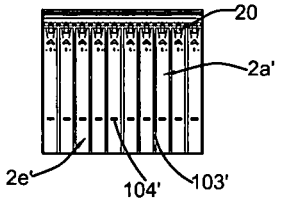
FIG. 13 is a side view of the crossed staggered and stacked-type air packaging device according to the above preferred embodiment of the present invention after the crossed staggered and stacked-type air packaging device is folded and heat-sealed.
Figure 14:
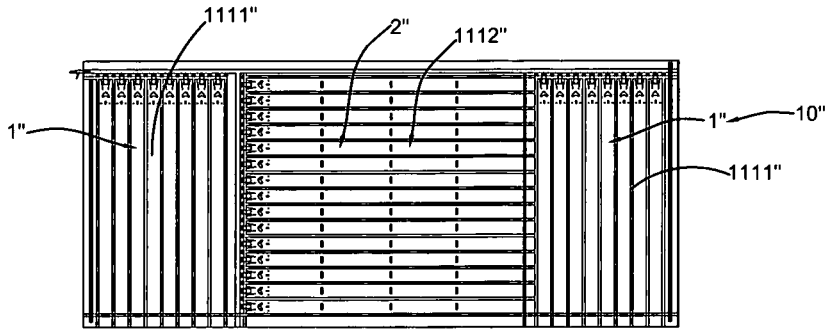
FIG. 14 illustrates an unfolded state of a crossed staggered and stacked-type air packaging device according to an alternative mode of the above another preferred embodiment of the present invention before the crossed staggered and stacked-type air packaging device is inflated.

FIG. 11, FIG. 12 and FIG. 13 illustrate a crossed staggered and stacked-type air packaging device according to a second preferred embodiment of the present invention. Relative to the crossed staggered and stacked-type air packaging device forming the triangle spatial configuration, the crossed staggered and stacked-type air packaging device according to the second preferred embodiment forms an air packaging body with a roughly rectangle configuration, so as to be suitable to package flat-shaped or thin-shaped articles.

What is similar with the first preferred embodiment of the present invention, the crossed staggered and stacked-type air packaging device comprises two or more inflation packaging main body layers. For example, the crossed staggered and stacked-type air packaging device comprises an inner inflation packaging main body layer 1' and an outer inflation packaging main body layer 2'. The inner inflation packaging main body layer 1' and the outer inflation packaging main body layer 2' are arrange in a crossed and staggered stacking manner, so as to enhance the cushion packaging performance of the crossed staggered and stacked-type air packaging device. It is worth mentioning that the inner inflation packaging main body layer 1' and the outer inflation packaging main body layer 2' can be independent inflation structures connected to be a whole structure in a heat sealing connection manner. According to some other embodiments of the present invention, the inner inflation packaging main body layer 1' and the outer inflation packaging main body layer 2' forms an integral structure. In the following description to the present invention, as an example, the inner inflation packaging main body layer 1' and the outer inflation packaging main body layer 2' forms an integral structure. In detail, the inner inflation packaging main body layer 1' and the outer inflation packaging main body layer 2' are integrally formed by the inflatable main body 10'. Of course, one skilled in the art will understand that the crossed staggered and stacked-type air packaging device formed by independent inner inflation packaging main body layer 1' and outer inflation packaging main body layer 2' also has the crossed and staggered stacked structure, so as to enhance the cushion packaging performance of the crossed staggered and stacked-type air packaging device.

Referring to FIG. 12, according to this embodiment, the inflatable main body 10' is formed by two lines of inflation units 11' arranged side by side. One of the inflation units 11' forms an inner inflation unit 1111'. The other one of the inflation units 11' forms an outer inflation unit 1112'. The extending direction of the inner inflation unit 1111' is different from the extending direction the outer inflation unit 1112'. The inner inflation unit 1111' forms the inner inflation packaging main body layer 1'. The outer inflation unit 1112' forms the outer inflation packaging main body layer 2'. When the inner inflation packaging main body layer 1' and the outer inflation packaging main body layer 2' are arranged in a crossed, staggered and stacked manner, the extending direction of the inner inflation unit 1111' is different from the extending direction the outer inflation unit 1112'. Preferably, the extending direction of the inner inflation unit 1111' is vertical with the extending direction of the outer inflation unit 1112'.

Each inner inflation unit 1111' and each outer inflation unit 1112' of outer inflation unit 1112' the inflatable main body 10' has a plurality of bending seams 104', so that each inner inflation unit 1111' and each outer inflation unit 1112' forms corresponding sub-inflation units 111'. It is worth mentioning that the position of the bending seams 104' of the inner inflation unit 1111' is corresponding. In other words, the inflatable main body 10' has more than one line of interval provided bending seams 104'. The bending seams 104' provided to the inflation units 11' are arranged directly, but the bending seams 104' are not connected with each other, so that side walls and a bottom wall of the crossed staggered and stacked-type air packaging device are formed between two adjacent lines of bending seams 104'. The side walls and the bottom wall define the accommodation cavity 100 being used to accommodate an article. In other words, the inflatable main body 10' has more than one line of bending seams 104' being used to bend. Each line of the bending seams 104' are arranged as a nodal line, so that the inflatable main body 10' forms a plurality of side walls and a bottom wall along the bending seams 104'.

In detail, according to the embodiment illustrated in FIG. 12, the inner inflation unit 1111' comprises two lines of bending seams 104'. The outer inflation unit 1112' comprises two lines of bending seams 104'. The extending direction of the bending seams 104' of the inner inflation unit 1111' is vertical with the extending direction of the bending seams 104' of the outer inflation unit 1112'. The inner inflation unit 1111' and the outer inflation unit 1112' are able to be bended along the bending seams 104', so that the inner inflation unit 1111' forms the side walls and bottom wall of the inner inflation packaging main body layer 1', and that the outer inflation unit 1112' forms the side walls and bottom wall of the outer inflation packaging main body layer 2', so as to form the crossed staggered and stacked-type air packaging device.

It is worth mentioning that the bending seams 104' have not divided adjacent sub-inflation units 111'. In other words, at least one communicating channel 112' is formed between adjacent sub-inflation units 111'. Hence, while air is inflated through the inflation opening 13, the air will enter into each of the sub-inflation units 111' through the communicating channel 112'. For example, the bending seams 104' are formed to the center of the position between two adjacent sub-inflation units 111'. The communicating channels 112' are formed to two sides of each bending seam 104'. According to other embodiments of the present invention, the bending seams 104' can be formed to two sides of each sub-inflation unit 111', so that the communicating channel 112' is formed in the center position.

In addition, an extended dividing seam 103' is formed between two adjacent inflation units 11'. According to some embodiments, each dividing seam 103' is embodied as a heat sealing line between adjacent inflation units 11', so that the inflation cavity 12' is divided by the dividing seam 103' to form a plurality of independent inflation cavities 12'. Thus, if any one of the inflation units 11' is damaged to leak gas, other inflation units 11' will not be affected. In other words, other inflation units 11' can still provide cushion performance of the article being packaged.

Referring to FIG. 11 and FIG. 12, the inner inflation unit 1111' of the inner inflation packaging main body layer 1' is bended along the bending seams 104' and the dividing seam 103' dividing seam 103', so as to form a front side wall 1*a*', a rear side wall 1*b*', a right side wall 1*c*', a left side wall 1*d*' and a bottom wall 1*e*'. The front side wall 1*a*', the rear side wall 1*b*', the right side wall 1*c*', the left side wall 1*d*' and the bottom wall 1*e*' of the inner inflation packaging main body layer 1' defines the accommodation cavity 100'. Correspondingly, the outer inflation packaging main body layer 2' is bended along the bending seams 104' and the dividing seam 103' dividing seam 103', so as to form a front side wall 2*a*', a rear side wall 2*b*', a right side wall 2*c*', a left side wall 2*d*' and a bottom wall 2*e*'. The positions of the front side wall 1*a*', the rear side wall 1*b*', the right side wall 1*c*', the left side wall 1*d*' and the bottom wall 1*e*' of the inner inflation packaging main body layer 1' are corresponded with the positions of the front side wall 2*a*', the rear side wall 2*b*', the right side wall 2*c*', the left side wall 2*d*' and the bottom wall 2*e*', so that the outer inflation packaging main body layer 2' is packaged out of the inner inflation packaging main body layer 1', so that the inner inflation packaging main body layer 1' and the outer inflation packaging main body layer 2' form a bag-in-bag structure. According to some embodiments of the present invention, the inner inflation packaging main body layer 1' can be hung within the outer inflation packaging main body layer 2', so as to enhance the cushion packaging performance of the bottom of the crossed staggered and stacked-type air packaging device.

Even so, two ends of the inner inflation unit 1111' forming the inner inflation packaging main body layer 1' can be an un-inflatable structure. Thus the inner inflation packaging main body layer 1' only comprises the front side wall 1*a*', the rear side wall 1*b*' and the bottom wall 1*e*'. In other words, relative to the above embodiment, the inner inflation packaging main body layer 1' according to this embodiment does not comprise the right side wall 1*c*' and the left side wall 1*d*', so as to satisfy different application requirements.

In addition, the inner inflation packaging main body layer 1' can be connected by an inner connection seam 114', so that the inner inflation packaging main body layer 1' defines the accommodation cavity 100'. Correspondingly, the outer inflation packaging main body layer 2' can be connected by an outer connection seam 115', so that the outer inflation packaging main body layer 2' is formed out of the inner inflation packaging main body layer 1'. It is worth mentioning that the inner connection seam 114' and the outer connection seam 115' can be formed via heat sealing technology. Thus, referring to FIG. 13, after the crossed staggered and stacked-type air packaging device is formed, extending direction of the inflation units 11' of the inner inflation packaging main body layer 1' is different from the extending direction of the inflation units 11' of the outer inflation packaging main body layer 2', and a cushion space is formed between the inner inflation packaging main body layer 1' and the outer inflation packaging main body layer 2', so as to observably enhance the cushion packaging performance of the crossed staggered and stacked-type air packaging device.

In detail, the inner connection seam 114' and the outer connection seam 115' are respectively provided to two sides of the inflatable main body 10'. The inner connection seam 114' and the outer connection seam 115' can be formed by respectively heat sealing the first chamber layer 101' and the second chamber layer 102' at two sides of the inflatable main body 10'. The inner connection seam 114' and the outer connection seam 115' can be formed at the same time or be formed respectively.

In addition, the inflatable main body 10' further comprises a main channel sealing seam 116' and an end sealing seam 117'. The main channel sealing seam 116' can be formed by heat sealing the ends of the first chamber layer 101 and the ends of the second chamber layer 102 of the inflatable main body 10'. The end sealing seam 117' can be formed by heat sealing the sides of the first chamber layer 101 and the sides of the second chamber layer 102 of the inflatable main body 10'. In the manufacturing process of the crossed staggered and stacked-type air packaging device, the main channel sealing seam 116' and the end sealing seam 117' can be formed by once heat sealing. According to this preferred embodiment, the inner inflation packaging main body layer 1' and the outer inflation packaging main body layer 2' outer inflation packaging main body layer 2' are heat sealed together via the main channel sealing seam 116' and the end sealing seam 117', so that the inner inflation packaging main body layer 1' and the outer inflation packaging main body layer 2' from an integral connection structure.

According to an alternative mode of the above preferred embodiment, in similar, the inflatable main body 10" is formed by three lines of inflation units 11" arranged side by side. Two lines of the three lines of inflation units 11" form two inner inflation units 1111". The other line of the three line of inflation units 11" forms an outer inflation unit 1112". The inner inflation unit 1111" is symmetrically provided between the outer inflation unit 1112". The extending direction of the inner inflation units 1111" is different from the extending direction of the outer inflation unit 1112". Each inner inflation unit 1111" forms an inner inflation packaging main body layer 1". The inner inflation packaging main body layer 1" defines an accommodation cavity 100 being used to accommodate article to be packaged. Correspondingly, the outer inflation unit 1112" forms an outer inflation packaging main body layer 2". The outer inflation packaging main body layer 2" is packaged out of the inner inflation packaging main body layer 1", so that the inner inflation packaging main body layer 1" and the outer inflation packaging main body layer 2" form a bag in bag structure, so as to enhance the cushion performance of the crossed staggered and stacked-type air packaging device. The inflation units 11' of the inner inflation packaging main body layer 1" and the inflation units 11' of the outer inflation packaging main body layer 2" are arranged in a crossed and staggered stacking manner. In other words, the extending direction of the inner inflation units 1111" is different from the extending direction of the outer inflation unit 1112". Preferably, the extending direction of the inner inflation units 1111" is vertical with the extending direction of the outer inflation unit 1112".

According to some embodiments of the present invention, two ends of the inner inflation units 1111" can be heat sealed together in a heat sealing manner. Thus, the inner inflation packaging main body layer 1" formed by the inner inflation units 1111" has a bottom wall. According to other embodiments of the present invention, two ends of the inner inflation units 1111" are not sealed together. In other words, the inner inflation packaging main body layer 1" formed by the inner inflation units 1111" has no bottom wall. Thus, the inner inflation packaging main body layer 1" has two free ends. After the crossed staggered and stacked-type air packaging device is inflated with gas, the free ends of the inner inflation packaging main body layer 1" will close to each other automatically. The distance between the free ends smaller and smaller in the direction far away from the cavity opening. After the article is accommodated to the accommodation cavity, the free ends of the inner inflation packaging main body layer 1 will hold the article automatically, so that the article being packaged will not fall out of the crossed staggered and stacked-type air packaging device due to some inartificial reasons, so as to remarkably enhance the reliability of the applied crossed staggered and stacked-type air packaging device.

Figure 15:
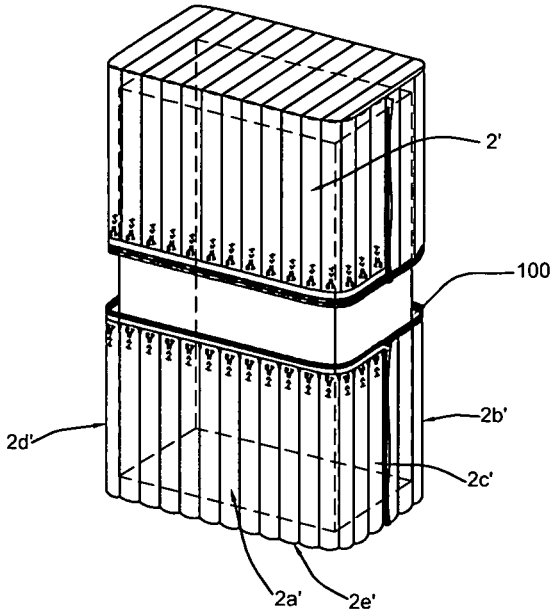
FIG. 15 illustrates an application method of the crossed staggered and stacked-type air packaging device according to the above another preferred embodiment of the present invention.

In other words, according to this preferred embodiment of the present invention, the crossed staggered and stacked-type air packaging device forms a roughly rectangular shaped accommodation cavity 100. Referring to FIG. 15, two crossed staggered and stacked-type air packaging device work with each other, so as to be suitable to package flat or thin articles. Even so, one skilled in the art will understand that the application of the crossed staggered and stacked-type air packaging device is not limited to the two kinds illustrated in FIG. 10 and FIG. 15. The crossed staggered and stacked-type air packaging device can be used to package more kinds of articles.

Correspondingly, the present invention provides a method of manufacturing a crossed staggered and stacked-type air packaging device. The shape of the crossed staggered and stacked-type air packaging device manufactured in this method can have triangle spatial configuration, rectangle spatial configuration, or some other spatial configurations. In detail the method comprises the following steps:

(a) forming at least one inner inflation unit 1111 and at least one outer inflation unit 1112 to an inflatable main body 10, wherein the inner inflation unit 1111 and the outer inflation unit 1112 respectively comprise at least one sub-inflation unit 111; and (b) defining an accommodation cavity 100 being used to accommodate at least one article, and forming an inner inflation packaging main body layer 1 and an outer inflation packaging main body layer 2 stacked with each other respectively by bending the inner inflation unit 1111 and by bending the outer inflation unit 1112, wherein the extending direction of at least one sub-inflation unit 111 of the inner inflation packaging main body layer 1 is different from the extending direction of at least one sub-inflation unit 111 of the outer inflation packaging main body layer 2.

According to one embodiment of the present invention, the step (a) further comprises the following steps:

(a. 1) overlapping a first chamber layer 101, a second chamber layer 102 and valve films forming an inflation valve 20, and forming the inflatable main body 10 being able to store gas; and (a. 2) heat-sealing the first chamber layer, the second chamber layer and the valve films along a plurality of dividing seams 103, so as to form a plurality of side by side and independent inflation units 11, wherein each inflation unit 11 is provided with at least one the inflation valve 20, wherein the inflatable main body 10 forms an inflation opening 13 and a main channel 14, wherein air enters into the main channel 14 from the inflation opening 31 and then enters into each inflation unit 11 from the main channel 14 through the inflation valve 20.

Furthermore, the step (b) further comprises the following step: bending the inflatable main body 10 along at least one bending seam 31, so as to form the inner inflation packaging main body layer 1 and the outer inflation packaging main body layer 2.

Furthermore, the above method further comprises the following step: forming one or more turning portions 30 connecting the inner inflation packaging main body layer 1 and the outer inflation packaging main body layer 2, wherein each turning portion 30 comprises a plurality of turning inflation unit 32 extended between adjacent turning seams 31, and each turning inflation unit 32 communicates with the sub-inflation unit 111 of the inner inflation packaging main body layer 1 and the outer inflation packaging main body layer 2, so that the crossed staggered and stacked-type air packaging device forms an air packaging body with a triangle spatial configuration.

According to some other embodiments of the present invention, the step (a) further comprises the following steps:

(a. 3) overlapping a first chamber layer 101, a second chamber layer 102 and valve films forming an inflation valve 20, and forming the inflatable main body 10 being able to store gas; and (a. 4) heat-sealing the first chamber layer, the second chamber layer and the valve films along a plurality of dividing seams 103, so as to form at least two rows of side by side and independent inflation units 11, wherein each row of the inflation unit 11 has different extending directions, wherein each inflation unit 11 is provided with at least one the inflation valve 20, wherein the inflatable main body 10 forms an inflation opening 13 and a main channel 14, wherein air enters into the main channel 14 from the inflation opening 13 and then enters into each inflation unit from the main channel 14 through the inflation valve 14.

Furthermore, the step (b) further comprises the following step: bending the inflatable main body 10 along at least one bending seam 31, so as to form the inner inflation packaging main body layer 1 and the outer inflation packaging main body layer 2, so that the crossed staggered and stacked-type air packaging device forms an air packaging body with a rectangular spatial configuration.

Preferably, the angle between the sub-inflation unit 111 of the inner inflation packaging main body layer 1 and the sub-inflation unit 111 of the outer inflation packaging main body layer 2 is greater than 0°, and less than 90°. More preferably, the extending direction of the sub-inflation unit 111 of the inner inflation packaging main body layer 1 is vertical with the extending direction of the sub-inflation unit 111 of the outer inflation packaging main body layer 2.

Figure 16:
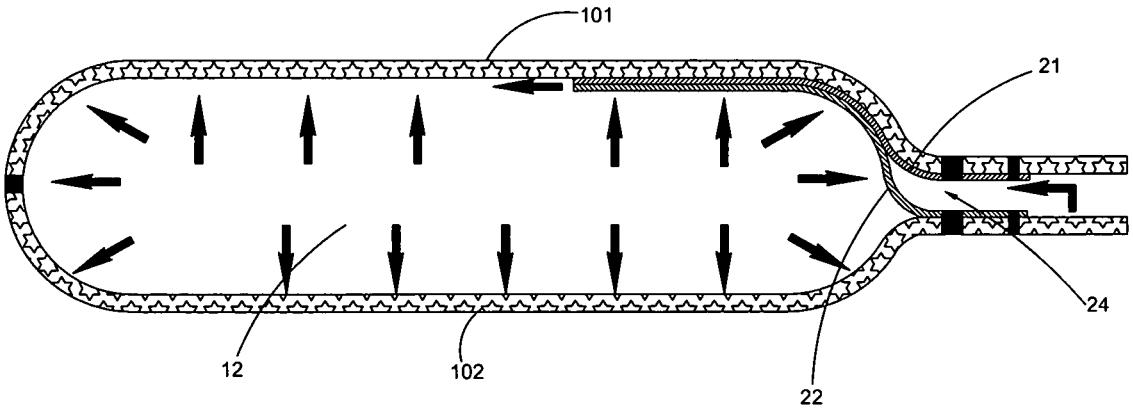
FIG. 16 illustrates a one-way inflation valve of the crossed staggered and stacked-type air packaging device according to the above preferred embodiment of the present invention.
Figure 17:
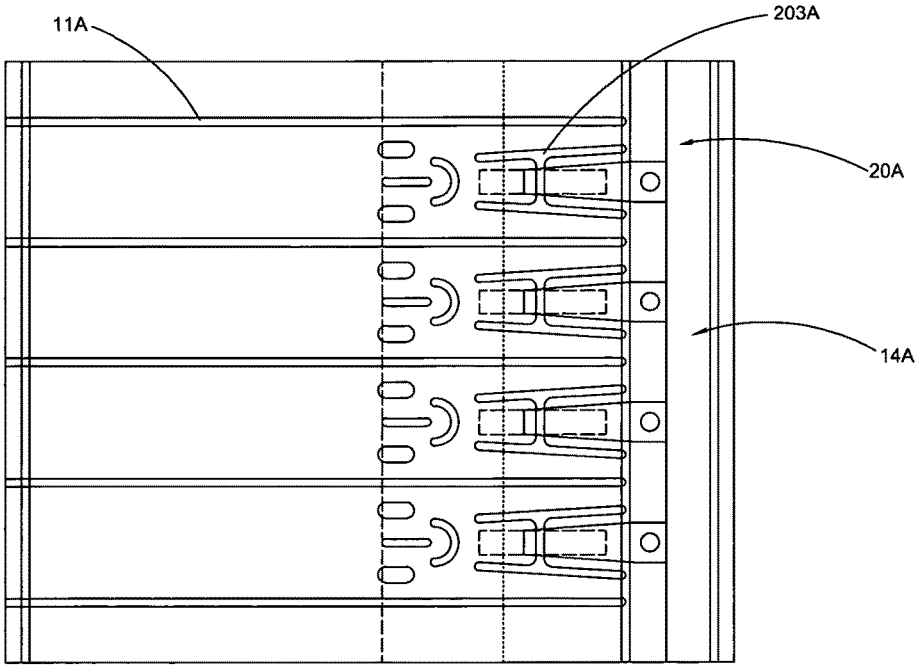
FIGS. 17~19B illustrate another one-way inflation valve of the crossed staggered and stacked-type air packaging device according to the above preferred embodiment of the present invention.
Figure 18:
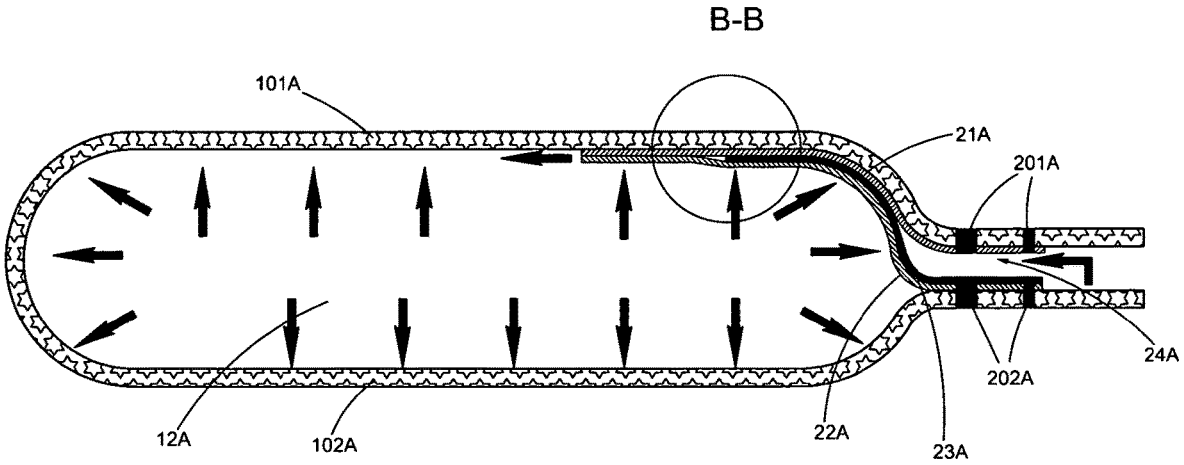
Figure 19A:
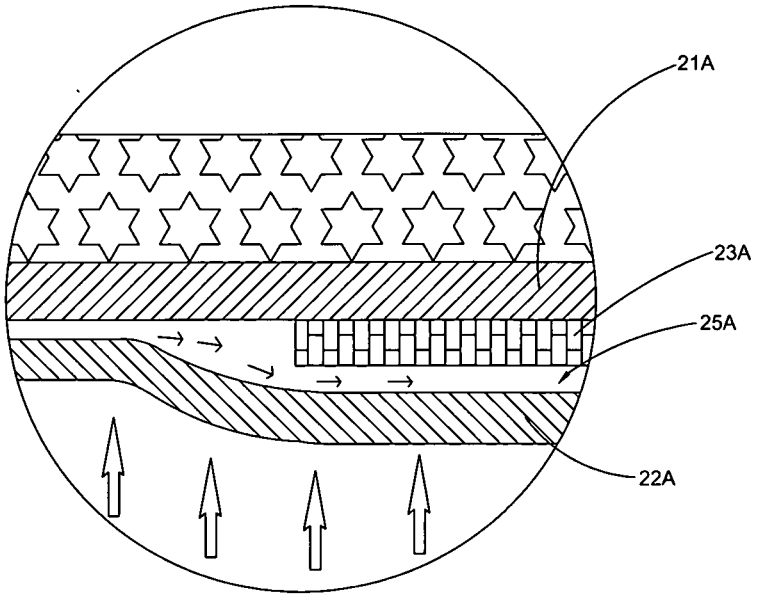
Figure 19B:
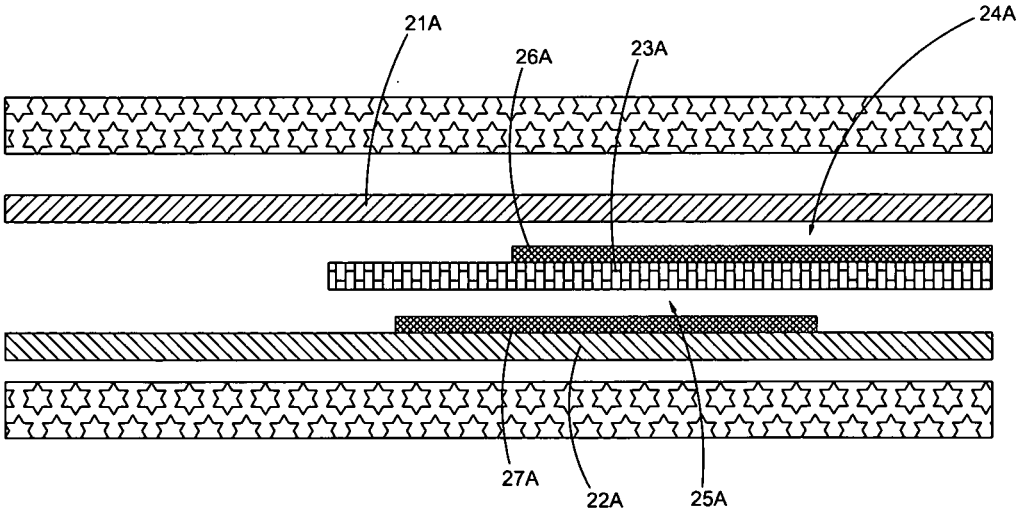

Referring to FIG. 16, the inflation valves 20 are non-return valves, wherein each inflation valve 20 comprises two sealing films 21 and 22 being overlapped between the two chamber layers 101 and 102, so as to form a four-layer structure. A gas inflating channel 24 is formed between the sealing film 21 and 22. Accordingly, after the inflatable main body 10 being inflated, the two sealing films 21 and 22 attach together with each other, so as to seal the gas inflating channel 24, so as to seal gas into each inflation chamber 12 of the inflatable main body 10. If the inflatable main body 10 comprises the inflation units 11, a plurality of inflation valves 20 is correspondingly provided to each inflation unit 11, so as to seal gas into each inflation unit 11. Specially, the first sealing film 21 is overlapped to the first chamber layer 101. The second sealing film 22 is overlapped to the second chamber layer 102. While inflating the inflatable main body 10, gas is guided into the gas inflating channel 24 formed between the first sealing film 21 and the second sealing film 22. After the inflatable main body 10 is full of gas, the first sealing film 21 and the second sealing film 22 attach with each other, so as to seal the gas inflating channel 24 of the air bag. In addition, the pressure in the inflatable main body acts to the two sealing films 21 and 22, so as to ensure the two sealing films 21 and 22 attach together with each other, so as to prevent gas from leaking out of the inflation valves 20. In other words, the inflation valves are non-return valves, which allow gas entering into the inflatable main body 10 only, but can prevent gas from leaking.

The forming of the gas inflating channel 24 of the inflation valve 20 can be realized by providing an obstructing device between the two sealing films 21 and 22, so that while heat-sealing the two sealing films 21 and 22 and the two chamber layers 101 and 102, the two sealing films 21 and 22 will not be heat sealing together due to the obstructing device is provided, so as to form the gas inflating channel 24. According to a specific embodies, the obstructing device is made of heat-resisting printing ink.

FIG. 17 to FIG. 19B illustrate the structure of another inflation valve 20A. The inflation valve 20A is a double non-return valve, so as to provide double sealing effect to the air bag. The inflation valve 20A comprises a first sealing film 21A, a second sealing film 22A and a non-return sealing film 23A.

The first sealing film 21A and the second sealing film 22A are overlapped between the first chamber layer 101A and the second chamber layer 102A of the inflation unit 11. The first sealing film 21A and the second sealing film 22A are two thin flexibility films overlapped with each other made of plastic. Preferably, the first sealing film 21A and the second sealing film 22A are same films.

Each one of the first the sealing films 21A and the second sealing films 22A has a proximal edge extended to the entrance of the inflation valve 20A being provided at the inflation unit 11, and a distal edge extended into the inflation units. Preferably, the edge of the proximal edge and the distal edge of the first sealing film 21A and the second sealing film 22A are respectively connected with each other.

According to this preferred embodiment, the proximal edge of the first sealing film 21A is contacted to the first chamber layer 101A. The proximal edge of the second sealing film 22A is contacted to the second chamber layer 102A.

The non-return sealing film 23A is overlapped to the proximal end of the first sealing film 21A and the second sealing film 22A, so as to form an gas inflating channel 24A between the first sealing film 21A and the non-return sealing film 23A, and to form a non-return channel 25A between the non-return sealing film 23A and the second sealing film 22A.

The gas inflating channel 24A are provided to inflate gas into the inflation unit 11 via the inflating cavity 12A, until the pressure in the inflating cavity 12A makes the distal ends of the first sealing film 21A and the second sealing film 22A to be sealed to close the gas inflating channel 24A. According to this preferred embodiment of the present invention, if gas is leaked between the distal end of the first sealing film 21A and the distal end of the second sealing film 22A, the gas in the inflating cavity 12A is guided into the non-return channel 25A, so as to product pressure supplement, so as to further seal the gas inflating channel 24A, so as to enhance the sealing effect between the first sealing film 21A and the second sealing film 22A.

The gas inflating channel 24A has two opening ends, wherein the proximal opening end is formed between the proximal end of the first sealing film 21A and the proximal end of the non-return sealing film 23A. The distal opening end is extended to the distal ends of the first sealing film 21A and the second sealing film 22A, so as to communicate with the inflating cavity 12A. Pressed gas can be guided into the inflating cavity via the gas inflating channel 24A.

It is worth mentioning that after the inflation unit 11 is full of gas, the press in the inflating cavity 12A press to the first sealing film 21A and the second sealing film 22A, so as to seal the distal ends of the first sealing film 21A and the second sealing film 22A, and to seal the far openings ends of the gas inflating channel 24A. In addition, the distal end of the first sealing film 21A and the distal end of the second sealing film 22A are sealed together due to surface tension.

The non-return sealing film 23A is thin flexibility film made of plastic. Preferably, the non-return sealing film 23A, the first sealing film 21A and the second sealing film 22A are PE films. In addition, the thickness of each first chamber layer 101A and each second chamber layer 102A is bigger than the thickness of each first sealing film 21A, each second sealing film 22A and each non-return sealing film 23A.

According to this preferred embodiment of the present invention, the length of the non-return sealing film 23A is smaller than the length of each first sealing film 21A and each second sealing film 22A, so that when the non-return sealing film 23A is overlapped with the first sealing film 21A and the second sealing film 22A, the distal end of the first sealing film 21A and the distal end of the second sealing film 22A are overlapped together. It is worth mentioning that the length of the non-return sealing film 23A is the distance between the proximal end of the non-return sealing film 23A and the distal end of the non-return sealing film 23A. The length of the first sealing film 21A is the distance between the proximal end of the first sealing film 21A and the distal end of the first sealing film 21A. The length of the second sealing film 22A is the distance between the proximal end of the second sealing film 22A and the distal end of the second sealing film 22A.

Accordingly, the proximal ends of the first sealing film 21A and the second sealing film 22A are provided near to the proximal end of the non-return sealing film 23A. In addition, the proximal end of the non-return sealing film 23A contacts with the proximal end of the second sealing film 22A.

The non-return channel 25A is formed between the non-return sealing film 23A and the second sealing film 22A. The non-return channel 25A has an opening end facing to the inflating cavity 12A and a closed end facing to the opening of the inflation valves. In other words, the proximal end of the non-return channel 25A is the closed end, and the distal end of the non-return channel 25A is the opening end.

Accordingly, while gas is inflated into the non-return channel 25A via the opening end, the non-return channel 25A is inflated with air to imply the pressure, so as to further seal the gas inflating channel 24A between the first sealing film 21A and the second sealing film 22A.

It is worth mentioning that while inflating gas into the inflating cavity via the gas inflating channel 24A, the flow direction of the gas in the gas inflating channel 24A is opposite with the flow direction of the gas in the non-return. Hence, the gas will not be inflated into the non-return channel 25A. If gas is leaked to the non-return channel 25A via the inflating cavity 12A, the gas enters into the non-return channel 25A, so as to imply the pressure and further seal the gas inflating channel 24A, so as to prevent from gas leaking. It is worth mentioning that, before gas is leaked via the near opening end of the gas inflating channel 24A, the gas flows from the far opening end of the gas inflating channel 24A to the far opening end of the non-return channel 25A, so as to prevent from gas leaking. In addition, the non-return sealing film 23A and the first sealing film 21A are sealed together to seal the gas inflating channel 24A under the function of surface tension.

In order to provide the inflation valve 20A to the inflation unit 11, the inflation valve 20A further comprises a first sealing joint 201 sealing the first chamber layer 101A and the first sealing film 21A together at the valve opening of the inflation unit 11, and a second sealing joint 202 sealing the second chamber layer 102A, the non-return sealing film 23A and the second sealing film 22A together at the valve opening of the inflation unit 11.

Accordingly, the proximal end of the first sealing film 21A is attached with the first chamber layer 101A by the first sealing joint 201. The second chamber layer 102A is attached together with the proximal end of the second sealing film 22A and the proximal end of the non-return sealing film 23A via the second sealing joint 202A. Preferably, two interval sealing joints 201A are used to attach the first chamber layer 101A and the first sealing film 21A. Two interval second sealing joints 202A are used to attach the second chamber layer 102A, the non-return sealing film 23A and the second sealing film 22A. It is worth mentioning that, the first sealing joint 201A and the second sealing joint 202A can be heat-sealing lines or other shapes, such as a shape as a moon. In other words, the proximal end of the first sealing film 21A is heat-sealed together with the first chamber layer 101A at the sealing joint 201A. The second chamber layer 102A, the proximal end of the second sealing film 22A, and the proximal end of the non-return sealing film 22 are heat-sealed together with the second sealing joint 202A.

In order to ensure space can be kept between the first sealing film 21A and the non-return sealing film 23A at the heat-sealing process, the inflation valve 20A further comprises a first heat-resisting element 26A being provided between the first sealing film 21A and the non-return sealing film 23A, so as to ensure the gas inflating channel 24A can be formed. The first heat-resisting element 26A is used to prevent the first sealing film 21A and the non-return sealing film 23A from being attached together at the heat-sealing process.

In detail, the first heat-resisting element 26A is provided at the proximal ends of the first sealing film 21A and the non-return sealing film 23A and to the valve opening of the inflation unit 11, so as to ensure the proximal end of the gas inflating channel 24A being kept in an opening state.

In similar, in order to keep space between the second sealing film 22A and the non-return sealing film 23A at the heat-sealing process, the inflation valve 20A further comprises a second heat-resisting element 27A formed between the second sealing film 22A and the non-return sealing film 23A, so as to ensure the non-return channel 25A being formed.

In detail, the second heat-resisting element 27A is provided to the distal ends of the second sealing film 22A and the non-return sealing film 23A, so as to ensure the distal end of the non-return channel 25A can be kept in an opening state. It is worth mentioning that the proximal end of the non-return channel 25A is closed by the second sealing joint 202.

According to this preferred embodiment, the first heat-resisting element 26A and the second heat-resisting element 27A are two heat-resisting layers being coated to the predetermined position of respect corresponding films, so as to prevent the first heat-resisting element 26A and the second heat-resisting element 27A from being attached together at the sealing process. The first heat-resisting element 26A is extended to the proximal end of the non-return sealing film 23A, and faces to the first sealing film 21A. The second heat-resisting element 27A is extended to the distal end of the non-return sealing film 23A at the opposite side, and faces to the second sealing film 22A, wherein the second heat-resisting element 27A isn't provided to the opposite side of the proximal end of the non-return sealing film 23A, thus the proximal end of the non-return channel 25A can be closed by the second sealing joint 202A. It is worth mentioning that the second heat-resisting element 27A can not only avoid the non-return sealing film 23A from attach together without the second sealing film 22A, so as to ensure the distal end of the non-return channel 25A being kept in the opening state, and enhance the act of the non-return sealing film 23A and the first sealing film 21A, so as to close the gas inflating channel 24A at the act of surface tension.

The inflation valve 20A further comprises two side sealing joints 203A, i. e. two sealing joints, so as to attach the first sealing film 21A and the non-return sealing film 23A, so as to form the side walls of the gas inflating channel 24A. The width of the gas inflating channel 24A is defined by the two sides sealing joint 203A. In detail, the two side sealing joint 203A are two slant heat-sealing lines, so that the width of the gas inflating channel 24A decrease progressively from the valve opening of each inflating cavity. In other words, the near opening end of the gas inflating channel 24A is a bigger opening end communicating with the valve opening. The far opening end of the gas inflating channel 24A is a taper opening end communicating with the inflating cavity 12A. The taper gas inflating channel 24A further avoids gas from leaking from the inflating cavity 12A to the valve opening.

Preferably, the side sealing joint 203A is extended from the proximal end of the first sealing film 21A and the second sealing film 22A to the distal end of the first sealing film 21A and the second sealing film 22A. Hence, the side sealing joint 203A is provided to the proximal end of the first sealing film 21A and the second sealing film 22A and is attached together with the non-return sealing film 23A. The side sealing joint 203A is provided to the distal end of the first sealing film 21A and the second sealing film 22A, and is attached together with the first sealing film 21A and the second sealing film 22A.

Accordingly, in order to inflate into the inflation unit 11, the inserting head of the pump is inserted to the air inflating opening 13A, so as to inflate pressed gas into the gas inflating channel 24A, wherein the inflating direction is from the proximal end of the gas inflating channel 24A to the distal end of the inflating channel 24A. Thus the inflation unit 11 can be inflated. The pressure in the inflating cavity 12A becomes bigger, so as to stretch the first chamber layer 101A and the second chamber layer 102A. At the same time, the pressure acts to the first sealing film 21A and the second sealing film 22A, particularly acts to the distal ends of the first sealing film 21A and the second sealing film 22A. When the inflation unit 11 is full of gas, the volume of the gas being inflated reaches to the biggest value, the pressure in the inflating cavity 12A is big enough to seal the distal ends of the first sealing film 21A and the second sealing film 22A, so as to seal the far opening end of the gas inflating channel 24A automatically. Then the inserting foot of the pump can be pulled out of the air inflating opening 13A.

If the distal ends of the first sealing film 21A and the second sealing film 22A are not sealed together, gas in the inflating cavity 12A may be leaked to the gas inflating channel 24A. In order to avoid gas from being leaking to the gas inflating channel 24A, the non-return sealing film 23A and the first sealing film 21A are sealed, so as to seal the far opening of the gas inflating channel 24A. In detail, the air inflating direction of the non-return channel 25A is opposite with the inflating direction of the gas inflating channel 24A. In addition, when the opening end of the non-return channel 25A is opened, the far opening end of the gas inflating channel 24A is closed. Hence, gas enters into and is reminded in the non-return channel 25A from the opening end of the non-return channel 25A.

The non-return channel 25A is inflated with gas. The pressure in the non-return channel 25A is supplemented, so as to further seal the gas inflating channel 24A. Specially, the far opening end of the gas inflating channel 24A between the first sealing film 21A and the non-return sealing film 23A is sealed. In more detail, the higher the supplemented pressure in the non-return channel 25A is, the sealing effect of the non-return sealing film 23A is. In other words, before gas is leaked from the inflating cavity 12A to reduce the pressure in the inflating cavity 12A, the gas enters into the non-return channel 25A, so as to increase the pressure in the non-return channel 25A. Hence, the total pressure of the press provided by the gas being inflated, i. e. the total pressure of the inflating cavity 12A and the non-return channel 25A reminds unchanged. Hence, the gas entered into the non-return channel 25A from the inflating cavity 12A can enhance the sealing effect of the gas inflating channel 24A.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A crossed staggered and stacked-type air packaging device for packaging a corner of an electronic product, comprising an inflatable main body, wherein said inflatable main body comprises:

an inner inflation packaging main body layer which comprises a plurality of inner inflation units, wherein said inner inflation packaging main body layer has an accommodation cavity for receiving the corner of the electronic product being protected by said inner inflation units; and an outer inflation packaging main body layer which comprises a plurality of outer inflation units which is respectively communicated with said inner inflation units, wherein said inner inflation packaging main body layer is received in said outer inflation packaging main body layer in such a manner that said inner inflation units are respectively overlapped with said outer inflation units in a crossed and staggered manner, wherein said inflatable main body further comprises a plurality of turning seams, wherein said inner inflation packaging main body layer is folded along said turning seams to overlap with said outer inflatable packaging main body layer, wherein said inner inflation packaging main body layer forms a front side wall and a rear side wall, wherein each of said front side wall and said rear side wall is a triangle wall which is folded along said turning seam.

2. A crossed staggered and stacked-type air packaging device for packaging four corners of an electronic product, comprising four inflatable main bodies, wherein each of said inflatable main bodies comprises:

an inner inflation packaging main body layer which comprises a plurality of inner inflation units, wherein said inner inflation packaging main body layer has an accommodation cavity for receiving one of the four corners of the electronic product being protected by said inner inflation units; and an outer inflation packaging main body layer which comprises a plurality of outer inflation units which is respectively communicated with said inner inflation units, wherein said inner inflation packaging main body layer is received in said outer inflation packaging main body layer in such a manner that said inner inflation units are respectively overlapped with said outer inflation units in a crossed and staggered manner, wherein said inflatable main body further comprises a plurality of turning seams, wherein said inner inflation packaging main body layer is folded along said turning seams to overlap with said outer inflatable packaging main body layer, wherein said inner inflation packaging main body layer forms a front side wall and a rear side wall, wherein each of said front side wall and said rear side wall is a triangle wall which is folded along said turning seam.

* * * * *